US008167397B2

(12) United States Patent
Yasutani et al.

(10) Patent No.: US 8,167,397 B2
(45) Date of Patent: May 1, 2012

(54) RECORDING APPARATUS AND RECORDING METHOD

(75) Inventors: Jun Yasutani, Kawasaki (JP); Hiroyuki Saito, Yokohama (JP); Minoru Teshigawara, Saitama (JP); Takeshi Yazawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 316 days.

(21) Appl. No.: 12/638,867

(22) Filed: Dec. 15, 2009

(65) Prior Publication Data

US 2010/0149245 A1 Jun. 17, 2010

(30) Foreign Application Priority Data

Dec. 17, 2008 (JP) ..... 2008-321632

(51) Int. Cl.
*B41J 29/38* (2006.01)

(52) U.S. Cl. ..... 347/16

(58) Field of Classification Search ..... 347/5, 16, 347/19, 104; 271/227, 228
See application file for complete search history.

(56) References Cited

U.S. PATENT DOCUMENTS 6,568,784 B2 * 5/2003 Izumi et al. ..... 347/19
7,850,273 B2 * 12/2010 Yasutani et al. ..... 347/16
2008/0252677 A1 10/2008 Tajika et al.

FOREIGN PATENT DOCUMENTS

JP 2005-194043 A 7/2005
JP 2008-260170 A 10/2008

* cited by examiner

*Primary Examiner* — An Do
(74) *Attorney, Agent, or Firm* — Canon U.S.A., Inc. IP Division

(57) ABSTRACT

In the present invention, a conveying operation of a recording medium is controlled on the basis of a first correction value and a second correction value. The first correction value is used for correcting a conveying amount when the recording medium disengages from a first conveying roller, and the second correction value is used for correcting the phase of the first conveying roller and a second conveying roller when the recording medium disengages from the first conveying roller before the recording medium is nipped by the first conveying roller.

9 Claims, 18 Drawing Sheets

FIG. 15

| PATCH GROUP n | ACCUMULATIVE CONVEYING AMOUNT [mm] | PHASE DISTRIBUTION FOR AREA I | PHASE DISTRIBUTION FOR AREA II |
|---|---|---|---|
| 1 | 2.709 | 17 TO 24 | 73 TO 80 |
| 2 | 5.419 | 25 TO 32 | 81 TO 88 |
| 3 | 8.128 | 33 TO 40 | 89 TO 96 |
| 4 | 10.837 | 41 TO 48 | 97 TO 104 |
| 5 | 13.547 | 49 TO 56 | 105 TO 2 |
| 6 | 16.256 | 57 TO 64 | 3 TO 10 |
| 7 | 18.965 | 65 TO 72 | 11 TO 16 |
| 8 | 21.675 | 73 TO 80 | 17 TO 24 |
| 9 | 24.384 | 81 TO 88 | 25 TO 32 |
| 10 | 27.093 | 89 TO 96 | 33 TO 40 |
| 11 | 29.803 | 97 TO 104 | 41 TO 48 |
| 12 | 32.512 | 105 TO 2 | 49 TO 56 |
| 13 | 35.221 | 3 TO 10 | 57 TO 64 |
| 14 | 37.931 | 11 TO 16 | 65 TO 72 |
| 15 | 40.640 | 17 TO 24 | 73 TO 80 |
| 16 | 43.349 | 25 TO 32 | 81 TO 88 |
| 17 | 46.059 | 33 TO 40 | 89 TO 96 |
| 18 | 48.768 | 41 TO 48 | 97 TO 104 |
| 19 | 51.477 | 49 TO 56 | 105 TO 2 |
| 20 | 54.187 | 57 TO 64 | 3 TO 10 |
| 21 | 56.896 | 65 TO 72 | 11 TO 16 |
| 22 | 59.605 | 73 TO 80 | 17 TO 24 |
| 23 | 62.315 | 81 TO 88 | 25 TO 32 |
| 24 | 65.024 | 89 TO 96 | 33 TO 40 |
| 25 | 67.733 | 97 TO 104 | 41 TO 48 |
| 26 | 70.443 | 105 TO 2 | 49 TO 56 |
| 27 | 73.152 | 3 TO 10 | 57 TO 64 |
| 28 | 75.861 | 11 TO 16 | 65 TO 72 |
| 29 | 78.571 | 17 TO 24 | 73 TO 80 |
| 30 | 81.280 | 25 TO 32 | 81 TO 88 |

FIG. 16

| BLOCK NUMBER | BLOCK GROUP |
|---|---|
| 17 TO 24 | A |
| 25 TO 32 | B |
| 33 TO 40 | C |
| 41 TO 48 | D |
| 49 TO 56 | E |
| 57 TO 64 | F |
| 65 TO 72 | G |
| 73 TO 80 | H |
| 81 TO 88 | I |
| 89 TO 96 | J |
| 97 TO 104 | K |
| 105 TO 2 | L |
| 3 TO 10 | M |
| 11 TO 16 | N |

FIG. 17

| Block_Gr | Block No. | Xn(I) | PERIPHERAL SPEED FOR AREA I | Xn(II) | PERIPHERAL SPEED FOR AREA II |
|---|---|---|---|---|---|
| A | 17 TO 24 | 0.0172 | 0.0339025 | 0.0366 | 0.339429167 |
| B | 25 TO 32 | 0.01558 | 0.33899125 | 0.03861 | 0.339471042 |
| C | 33 TO 40 | 0.01611 | 0.339002292 | 0.03918 | 0.339482917 |
| D | 41 TO 48 | 0.0153 | 0.338985417 | 0.03753 | 0.339448542 |
| E | 49 TO 56 | 0.01101 | 0.338896042 | 0.0318 | 0.339329167 |
| F | 57 TO 64 | 0.00879 | 0.338849792 | 0.02073 | 0.339098542 |
| G | 65 TO 72 | 0.00543 | 0.338779792 | 0.0126 | 0.338929167 |
| H | 73 TO 80 | 0.00288 | 0.338726667 | 0.0117 | 0.338910417 |
| I | 81 TO 88 | 0.00471 | 0.338764792 | 0.0124 | 0.338925 |
| J | 89 TO 96 | 0.0042 | 0.338754167 | 0.01824 | 0.339046667 |
| K | 97 TO 104 | 0.00591 | 0.338789792 | 0.03342 | 0.339362917 |
| L | 105 TO 2 | 0.01047 | 0.338884792 | 0.03558 | 0.339407917 |
| M | 3 TO 10 | 0.01143 | 0.338904792 | 0.042 | 0.339541667 |
| N | 11 TO 16 | 0.01599 | 0.338999792 | 0.04482 | 0.339600417 |

RECORDING APPARATUS AND RECORDING METHOD

BACKGROUND OF THE INVENTION

1. Field of the Invention

The present invention relates to recording apparatuses and recording methods, and particularly, to a technology for correcting a conveyance error of a recording medium.

2. Description of the Related Art

When a recording medium is being conveyed in an inkjet recording apparatus (recording apparatus), the recording medium may come into contact with a recording head due to lifting or sagging of the recording medium, possibly resulting in contamination of or damages to the recording head. In order to solve such a problem, Japanese Patent Laid-Open No. 2005-194043 discloses a technology in which the peripheral speed of a conveying roller disposed upstream in the conveying direction is set higher than that of an eject roller disposed downstream and configured to convey the recording medium.

When the peripheral speed of the conveying roller is set higher than that of the eject roller, the recording medium is conveyed excessively by an amount greater than a predetermined conveying amount when the trailing end of the recording medium disengages from a nip portion of the conveying roller. This can possibly lower the image quality significantly. In light of this, for the purpose of achieving a stable conveying operation, the peripheral speed of the conveying roller is set equal to that of the eject roller, that is, the peripheral-speed ratio between the conveying roller and the eject roller is set to "1", at the timing at which the trailing end of the recording medium disengages from the nip portion of the conveying roller.

As a result of many analyses by the present inventors, the present inventors have discovered that the peripheral-speed ratio between the conveying roller and the eject roller is significantly affected by eccentricity of the rollers. The term "eccentricity of the rollers" refers to a state where a roller does not have the shape of a perfect circle in cross section and the center of rotation of the roller is thus shifted. When there is eccentricity in a roller, the length thereof in the circumferential direction (arc length) and the peripheral speed thereof undesirably fluctuate according to the rotational position (rotational phase) of the roller.

SUMMARY OF THE INVENTION

In the present invention, the conveying amount of a conveying roller and an eject roller is controlled on the basis of the degree of eccentricity in the conveying roller and the eject roller so as to stabilize the conveying amount at a timing at which a recording medium disengages from the conveying roller, thereby reducing degradation of the recording quality.

According to an aspect of the present invention, a recording apparatus that performs recording by using an ink-discharging recording head includes a first conveying roller disposed upstream relative to the recording head in a conveying direction of a recording medium and configured to convey the recording medium; a second conveying roller disposed downstream in the conveying direction and configured to convey the recording medium; and a controller configured to control a conveying operation of the recording medium on the basis of a first correction value and a second correction value. The first correction value is used for correcting a conveying amount when the recording medium disengages from the first conveying roller, and the second correction value is used for correcting the phase of the first conveying roller and the second conveying roller when the recording medium disengages from the first conveying roller before the recording medium is nipped by the first conveying roller. The controller switches the use of the first correction value and the second correction value in accordance with a conveyance path of the recording medium.

According to another aspect of the present invention, a recording method for performing recording by using an ink-discharging recording head includes a conveying step of conveying a recording medium by using a first conveying roller disposed upstream relative to the recording head in a conveying direction of the recording medium and configured to convey the recording medium and by also using a second conveying roller disposed downstream in the conveying direction and configured to convey the recording medium; and a controlling step of controlling a conveying operation of the recording medium on the basis of a first correction value and a second correction value. The first correction value is used for correcting a conveying amount when the recording medium disengages from the first conveying roller, and the second correction value is used for correcting the phase of the first conveying roller and the second conveying roller when the recording medium disengages from the first conveying roller before the recording medium is nipped by the first conveying roller. The controlling step includes switching the use of the first correction value and the second correction value in accordance with a conveyance path of the recording medium.

According to the present invention, the conveying amount at a timing at which the recording medium disengages from the conveying roller is stabilized, thereby reducing degradation of the recording quality.

Further features of the present invention will become apparent from the following description of exemplary embodiments with reference to the attached drawings.

BRIEF DESCRIPTION OF THE DRAWINGS

FIG. 15 is a table showing an example of allocation of phase blocks corresponding to patch columns of one test pattern and accumulative conveyance errors.

FIG. 16 is a table showing block groups corresponding to phase blocks in one test pattern.

FIG. 17 is a table showing an example of roller peripheral speeds corresponding to block groups in the test patterns in adjacent areas I and II.

DESCRIPTION OF THE EMBODIMENTS

Figure 1:
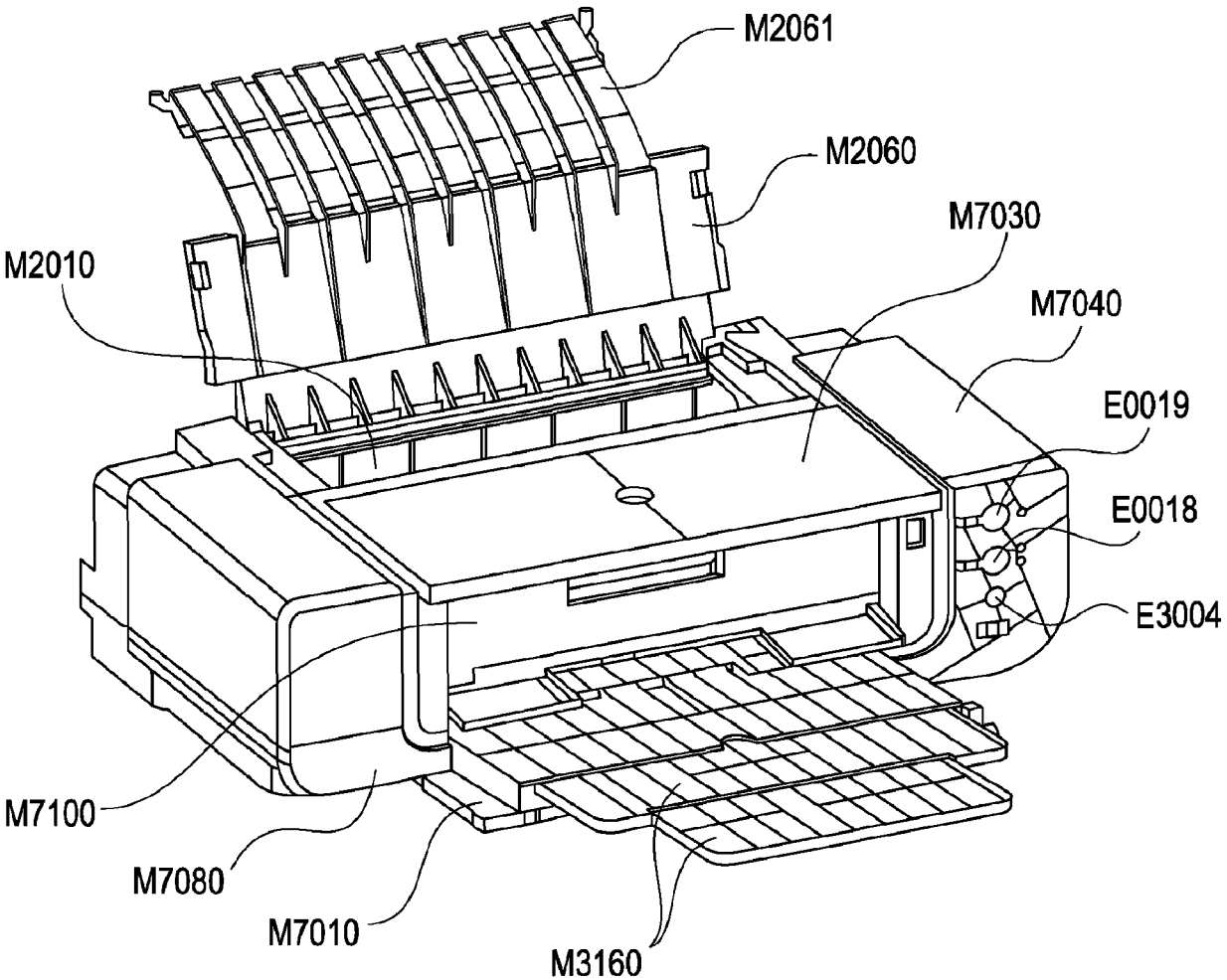
FIG. 1 is a perspective view of an inkjet recording apparatus according to an embodiment of the present invention when in use, as viewed from the front side thereof.
Figure 2:
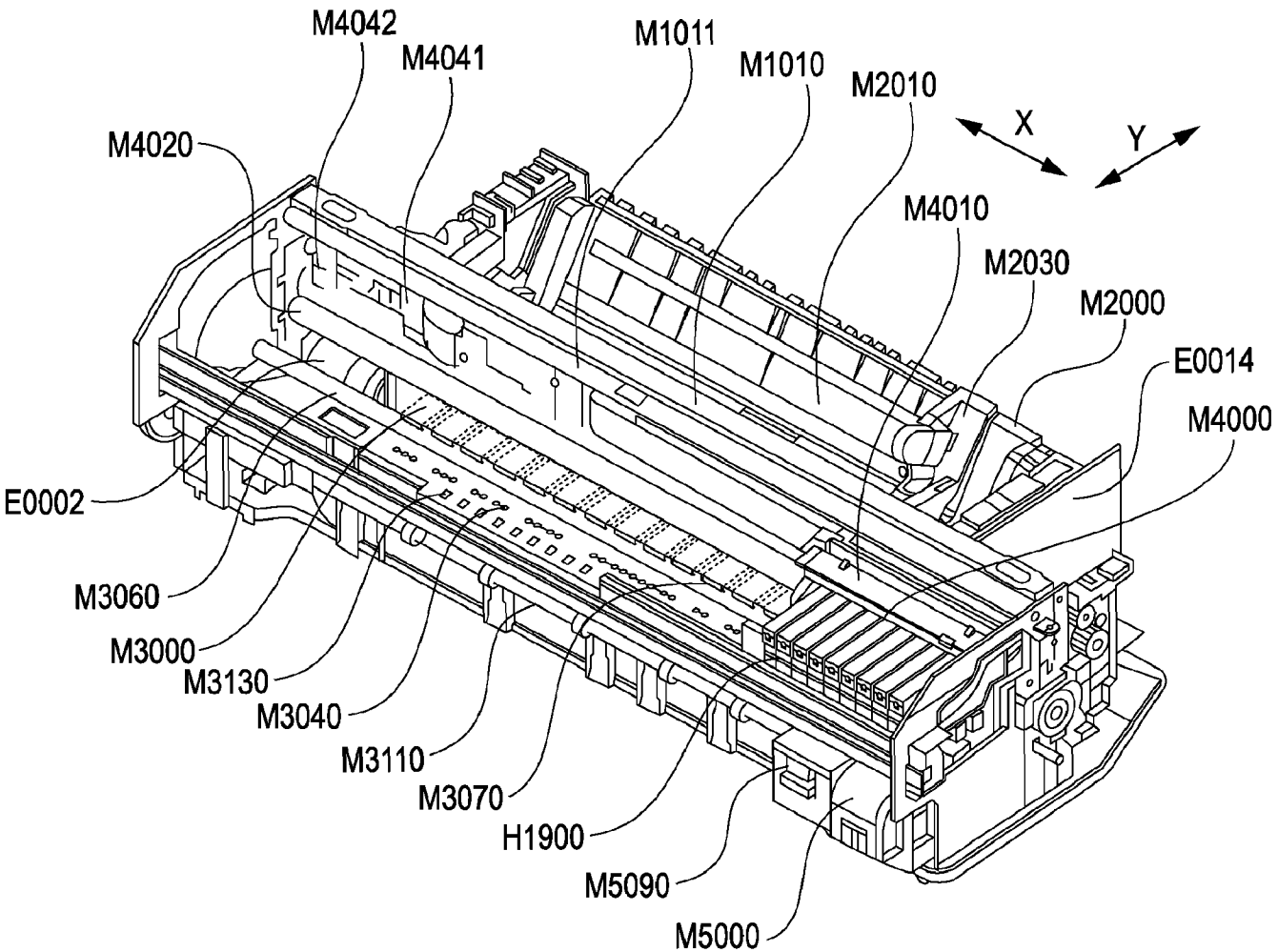
FIG. 2 is a perspective view illustrating an internal configuration of an apparatus body of the inkjet recording apparatus according to the embodiment, as viewed from an upper-left side thereof.
Figure 3:
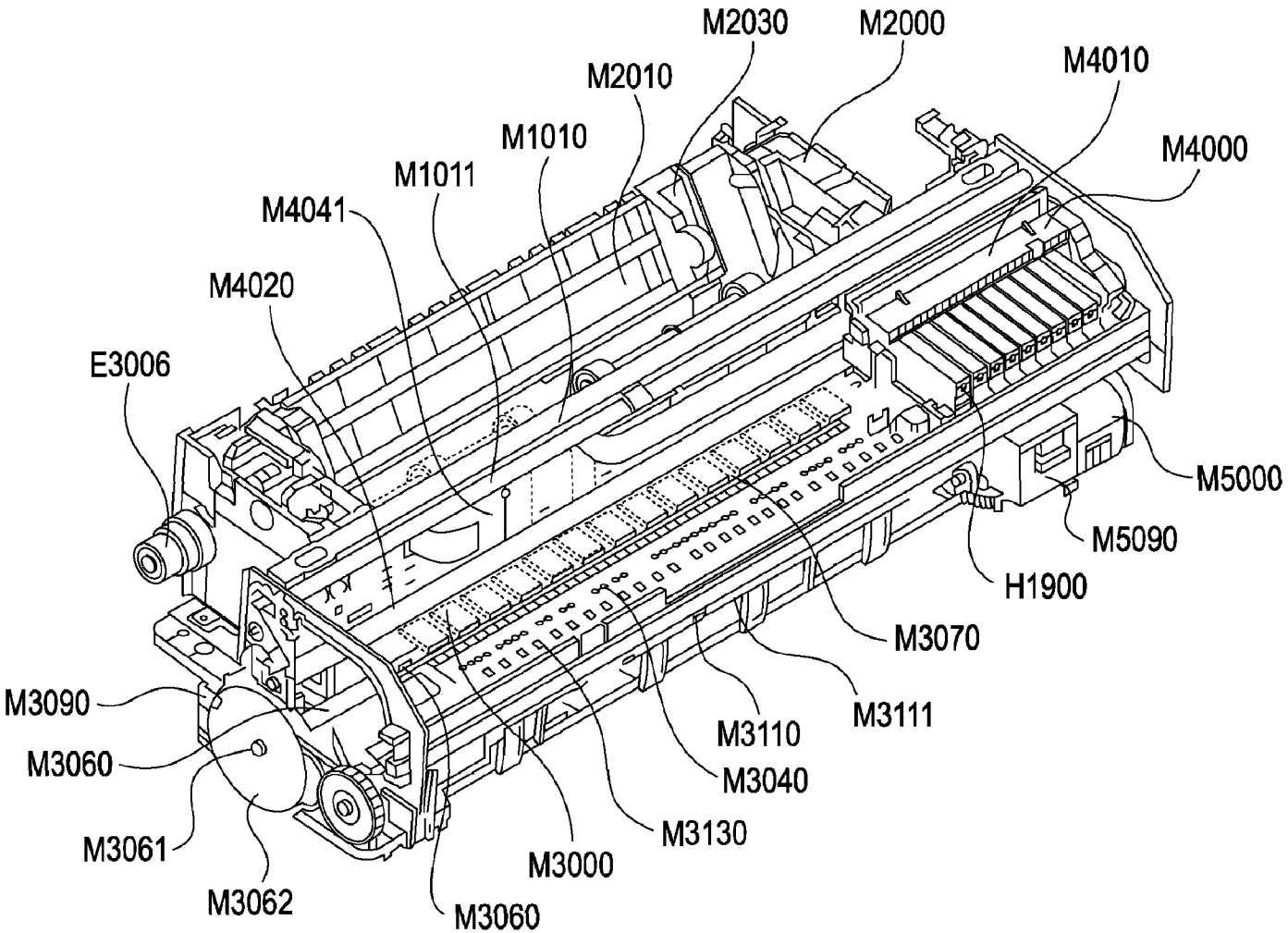
FIG. 3 is a perspective view illustrating the internal configuration of the apparatus body of the inkjet recording apparatus according to the embodiment, as viewed from an upper-right side thereof.

Preferred embodiments of the present invention will be described in detail below with reference to the drawings. The same components are given the same reference numerals, and descriptions of those components will not be repeated.

FIGS. 1 to 9 are diagrams for explaining the configuration of an inkjet recording apparatus according to an embodiment of the present invention. Components and units constituting the recording apparatus will be described in detail below with reference to FIGS. 1 to 9.

A. Sheet Feeder (FIGS. 1 to 4)

A sheet feeder includes a pressure plate M2010 that holds a recording medium or recording media at a stacking position, a feed roller M2080 that feeds recording media one by one, a separating roller M2041 that separates one recording medium from another, a return lever M2020 for returning a recording medium or recording media to the stacking position, and a base M2000. The pressure plate M2010, the feed roller M2080, the separating roller M2041, and the return lever M2020 are attached to the base M2000.

B. Sheet Conveyor (FIGS. 1 to 4)

Referring to FIGS. 1 to 4, a sheet conveyor mainly includes a chassis M1010 formed of a bent metal sheet, a conveying roller M3060 acting as a first roller that conveys a recording medium, and a paper end sensor (PE sensor) E0007. The conveying roller M3060 and the PE sensor E0007 are both rotatably attached to the chassis M1010. The conveying roller M3060 is formed of a metal shaft whose surface is coated with fine ceramic particles. The conveying roller M3060 is attached to the chassis M1010 in a state where metallic portions at the opposite ends of the conveying roller M3060 are supported by shaft bearings (not shown). In this state, a biasing force is applied to the conveying roller M3060 so that an appropriate load is applied thereto during rotation thereof, thereby allowing for a stable conveying operation.

A group of pinch rollers M3070 driven by the conveying roller M3060 is provided in contact with the conveying roller M3060. The pinch roller group M3070 is held by a pinch-roller holder M3000 and receives a biasing force from a pinch-roller spring (not shown) so that the pinch rollers M3070 are in pressure contact with the conveying roller M3060, thereby producing a conveying force for the recording medium. A rotation shaft of the pinch-roller holder M3000 is attached to a shaft bearing of the chassis M1010 and is configured to rotate in the shaft bearing.

A paper-guide flapper M3030 and a platen M3040 for guiding the recording medium are disposed at an entrance to which the recording medium is conveyed. The pinch-roller holder M3000 is provided with a PE-sensor lever M3021. The PE-sensor lever M3021 has a function of transmitting the detection of the leading end and the trailing end of the recording medium to the PE sensor E0007. The platen M3040 is attached to the chassis M1010 and is positioned therein. The paper-guide flapper M3030 is rotatable about a shaft bearing (not shown) and is positioned by being in contact with the chassis M1010. A recording head 4 (see FIG. 8) is provided on the downstream side of the conveying roller M3060 in the recording-medium conveying direction.

The conveying operation in the above configuration will now be described. A recording medium conveyed to the sheet conveyor is guided to the pinch-roller holder M3000 and the paper-guide flapper M3030 so as to be conveyed to a pair of rollers constituted by the conveying roller M3060 and the pinch roller group M3070. During this time, the PE-sensor lever M3021 detects the leading end of the recording medium, thereby determining a recording position for the recording medium. The pair of rollers constituted by the conveying roller M3060 and the pinch roller group M3070 are rotated by driving an LF motor E0002, and this rotation causes the recording medium to be conveyed on the platen M3040. The platen M3040 has ribs formed thereon that define a conveyance reference surface. These ribs are used for controlling the gap between the recording head 4 and the recording-medium surface. Together with a sheet ejector to be described below, the ribs also have a function of minimizing undulation of the recording medium.

C. Sheet Ejector (FIGS. 1 to 4)

Referring to FIGS. 1 to 4, a sheet ejector includes a first eject roller M3100 and a second eject roller M3110 that serve as second rollers, a plurality of spur rollers M3120, and a gear group. The first eject roller M3100 is formed of a metal shaft provided with a plurality of rubber segments. The first eject roller M3100 is driven by transmitting the driving force of the conveying roller M3060 to the first eject roller M3100 via an idler gear.

The second eject roller M3110 is formed of a plastic shaft with a plurality of elastomeric elastic members M3111 attached thereto. The second eject roller M3110 is driven by transmitting the driving force of the first eject roller M3100 to the second eject roller M3110 via an idler gear.

The spur rollers M3120 are formed by combining a thin circular plate, which is composed of, for example, SUS and has multiple protrusions on the periphery thereof, with a plastic member and are attached to a spur-roller holder M3130. The spur rollers M3120 are attached to the spur-roller holder M3130 by using a spur-roller spring defined by a rod-like coil spring, and at the same time, the spring force of the spur-roller spring causes the spur rollers M3120 to come into contact with the eject rollers M3100 and M3110 with a predetermined pressure. With this configuration, the spur rollers M3120 are rotatable by being driven by the two eject rollers M3100 and M3110. Some of the spur rollers M3120 are provided at positions corresponding to the rubber segments of the first eject roller M3100 or the elastic members M3111 of the second eject roller M3110 and mainly have a function of producing a conveying force for the recording medium. The other spur rollers M3120 are provided where the rubber segments or the elastic members M3111 are absent, and mainly have a function of reducing lifting of the recording medium during recording.

The gear group has a function of transmitting the driving force of the conveying roller M3060 to the eject rollers M3100 and M3110.

A sheet-end support (not shown) is provided between the first eject roller M3100 and the second eject roller M3110. The sheet-end support has a function of lifting both ends of the recording medium and supporting the recording medium in front of the first eject roller M3100 so as to protect a recorded image on the recording medium from, for example, scraping against a carriage. Specifically, a plastic member provided with a driven roller (not shown) at the tip thereof receives a biasing force from a sheet-end-support spring (not shown) and thus applies a predetermined pressure to the recording medium so as to lift both ends of the recording medium and generate elasticity in the recording medium, whereby the recording medium can be maintained at a predetermined position.

With the configuration described above, the recording medium having an image formed thereon is nipped between the first eject roller M3100 and the spur rollers M3120 so as to be conveyed and ejected to a sheet output tray M3160. The sheet output tray M3160 is divided into multiple segments and can be stored below a lower casing M7080 to be described later or drawn outward when in use.

The sheet output tray M3160 is designed to increase in height toward the tip thereof and have its opposite ends supported at a high position so as to allow for improved stackability of ejected recording media and also to allow for prevention of scratches on the recording face. The first eject roller M3100 and the second eject roller M3110 have the same roller diameter. A conveyance error occurring when conveying a recording medium using the first eject roller M3100 and the second eject roller M3110 exhibits a stable periodic function with the perimeter of both conveying rollers acting as one period. The first eject roller M3100 has an optical sensor (not shown) attached thereto for detecting the phase thereof. Detection by this sensor is based on a timing at which a flag on a projection passes the sensor.

D. Recording Head (FIG. 8)

When a recording medium is conveyed to the recording position by the sheet feeder and the sheet conveyor, the recording head 4 attached to a carriage 7 discharges ink towards the recording medium so as to record an image thereon. The recording head 4 is equipped with a unit (such as heat-generating resistors) configured to generate thermal energy as energy used for discharging ink. By using this thermal energy, the recording head 4 causes a change in state (film boiling) of ink. Alternatively, the recording head 4 may be equipped with elements for generating mechanical energy, such as piezo elements, as an energy generating unit and may be configured to discharge ink by using the mechanical energy.

The recording apparatus according to this embodiment is configured to form images by using pigmented inks of ten colors. Specifically, the ten colors include cyan (C), light cyan (Lc), magenta (M), light magenta (Lm), yellow (Y), first black (K1), second black (K2), red (R), green (G), and gray (Gray). A K-colored ink is either the aforementioned first black K1 or second black K2. The first black K1 ink corresponds to a photo black ink used for glossy recording on glossy paper, whereas the second black K2 ink corresponds to a matte black ink suitable for matte paper with no glossiness.

Figure 8:
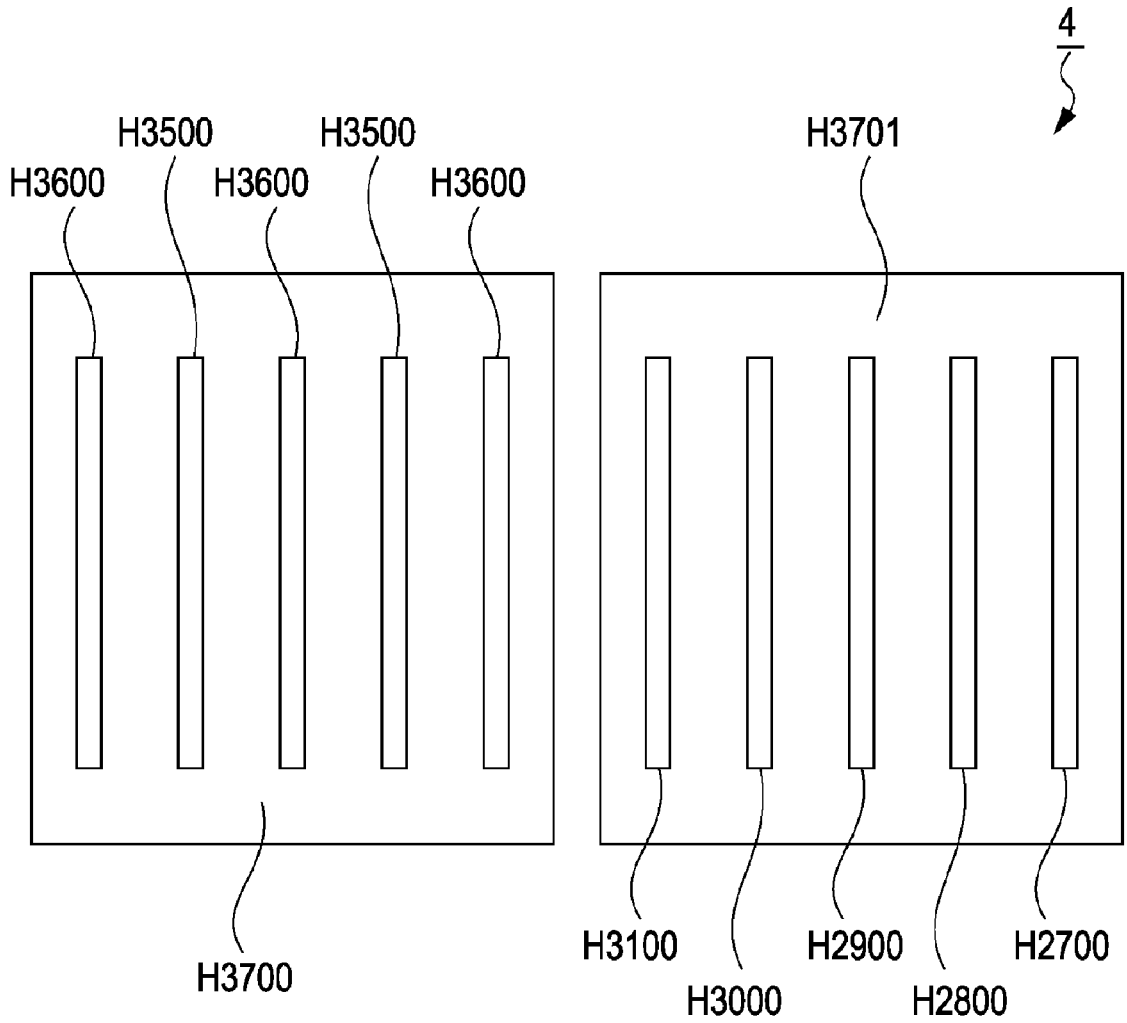
FIG. 8 schematically illustrates a recording head used in the embodiment, as viewed from a nozzle-face side thereof.

FIG. 8 schematically illustrates the recording head 4 used in this embodiment, as viewed from a nozzle-face side thereof. The recording head 4 in this embodiment includes a recording element substrate H3700 and a recording element substrate H3701, each having nozzle arrays for five of the aforementioned ten colors. Reference numerals H2700 to H3600 denote nozzle arrays corresponding to the ten different color inks.

The recording element substrate H3700 has nozzle arrays H3200, H3300, H3400, H3500, and H3600 each configured to perform a discharging operation and respectively supplied with gray ink, light cyan ink, first black ink, second black ink, and light magenta ink. The other recording element substrate H3701 has nozzle arrays H2700, H2800, H2900, H3000, and H3100 each configured to perform a discharging operation and respectively supplied with cyan ink, red ink, green ink, magenta ink, and yellow ink. Each nozzle array is constituted by 768 nozzles arranged at a pitch of 1200 dpi (dot/inch: reference value) in the recording-medium conveying direction, and each nozzle is configured to discharge about 3 picoliter ink droplets. The opening area of each nozzle is set to about 100 $\mu m^2$.

In this recording-head configuration, so-called single-pass recording can be carried out, in which recording on the same area on a recording medium is completed in one main scanning process. However, in order to reduce, for example, variations in the nozzles to enhance the recording quality, so-called multi-pass recording can also be carried out, in which recording on the same scan area on a recording medium is completed in multiple main scanning processes. The number of passes in multi-pass recording is appropriately set in accordance with the recording mode and other conditions.

The recording head 4 has a plurality of independent ink tanks detachably fitted thereto in correspondence with the color inks used. Alternatively, the recording head 4 may be supplied with inks from ink tanks provided in a stationary section of the apparatus via liquid supply tubes.

In a movable range of the recording head 4 in the main scanning direction as well as in a non-recording area which is an area from a recording medium P to the outside of the side edges of the platen M3040 is disposed a recovery unit 11 capable of facing the discharge face of the recording head 4. The recovery unit 11 has a known configuration as follows. Specifically, the recovery unit 11 includes a capping portion that covers the discharge face of the recording head 4, a suction mechanism that forcedly draws in ink by suction from the recording head 4 while the discharge face is covered, and a cleaning blade that wipes and cleans the ink discharge face.

The carriage 7 has a read sensor (scanner) (not shown) fitted thereto and is capable of reading the density of a test pattern used for conveying-amount correction to be described later.

Figure 5:
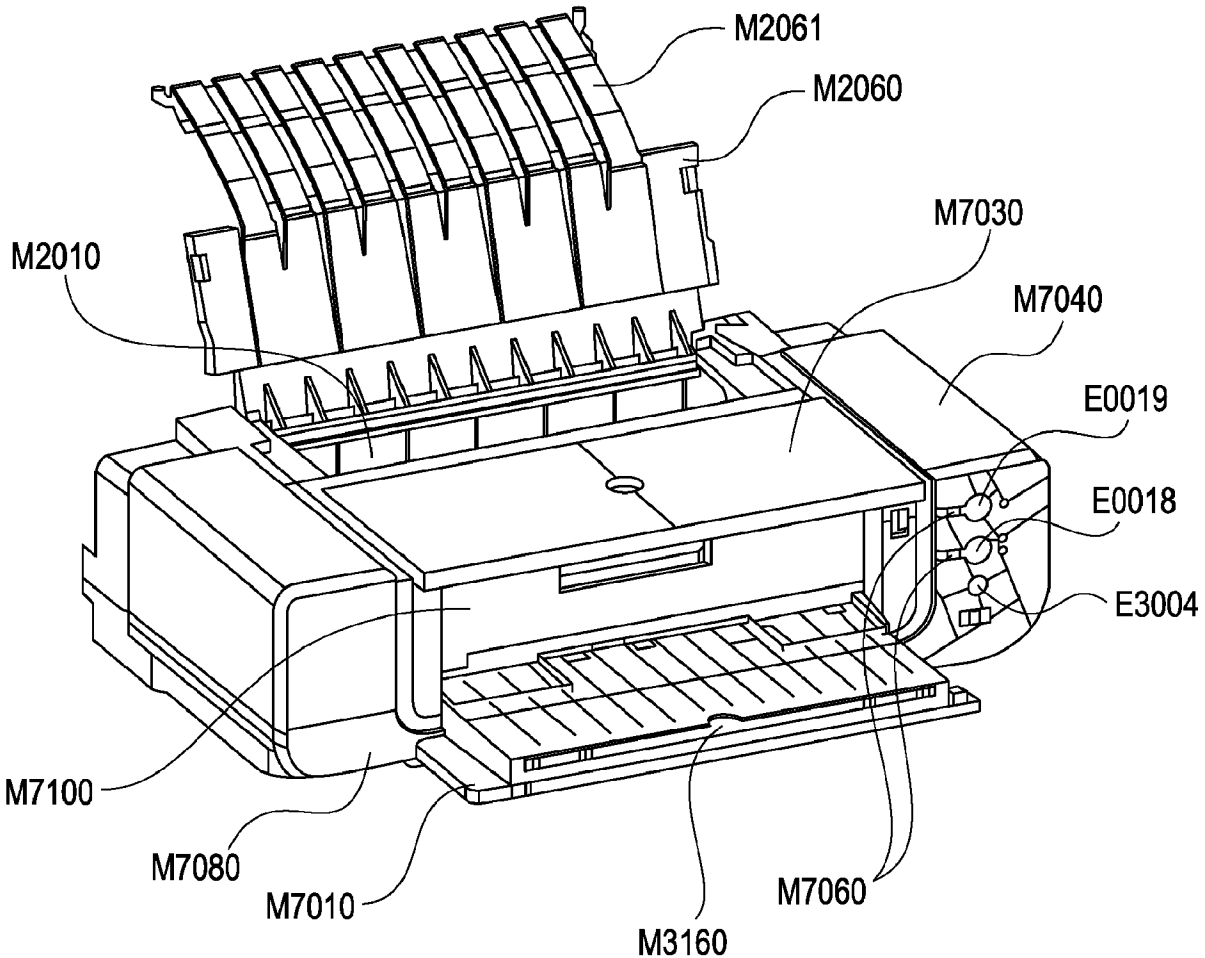
FIG. 5 is a perspective view of the inkjet recording apparatus according to the embodiment during flat-pass recording, as viewed from the front side thereof.
Figure 6:
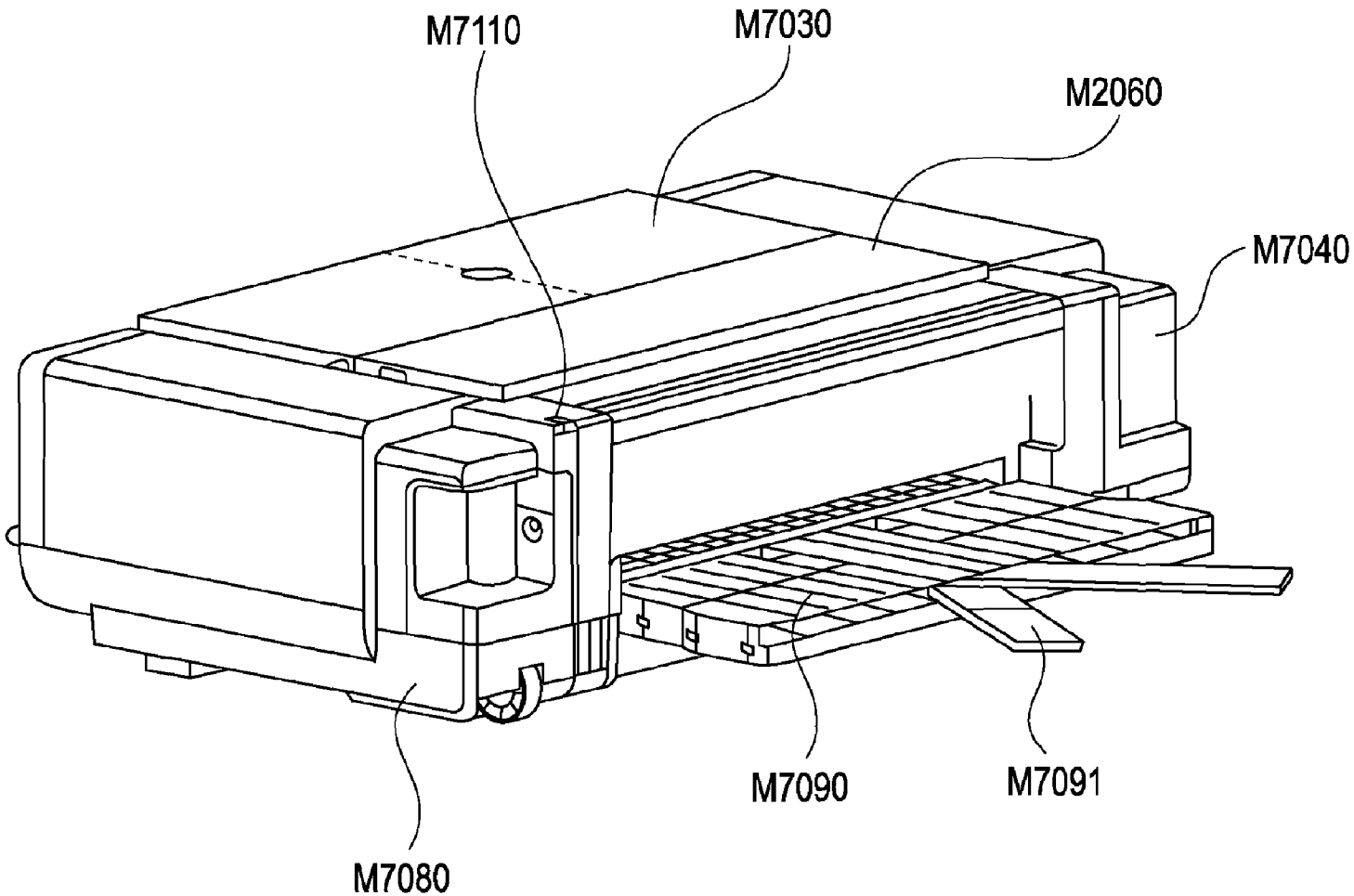
FIG. 6 is a perspective view of the inkjet recording apparatus according to the embodiment during flat-pass recording, as viewed from the rear side thereof.
Figure 7:
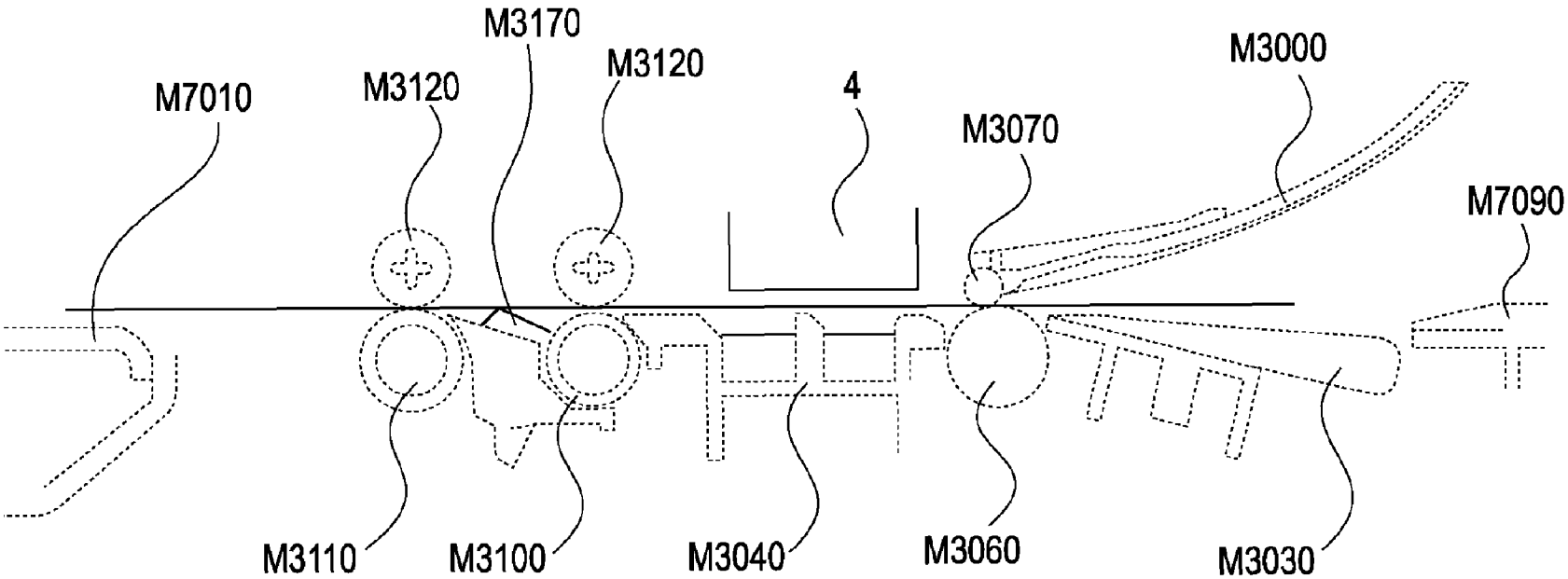
FIG. 7 is a schematic cross-sectional view for explaining a flat-pass recording operation performed in the embodiment.

E. Flat-Pass Unit (FIGS. 5 to 7)

Figure 4:
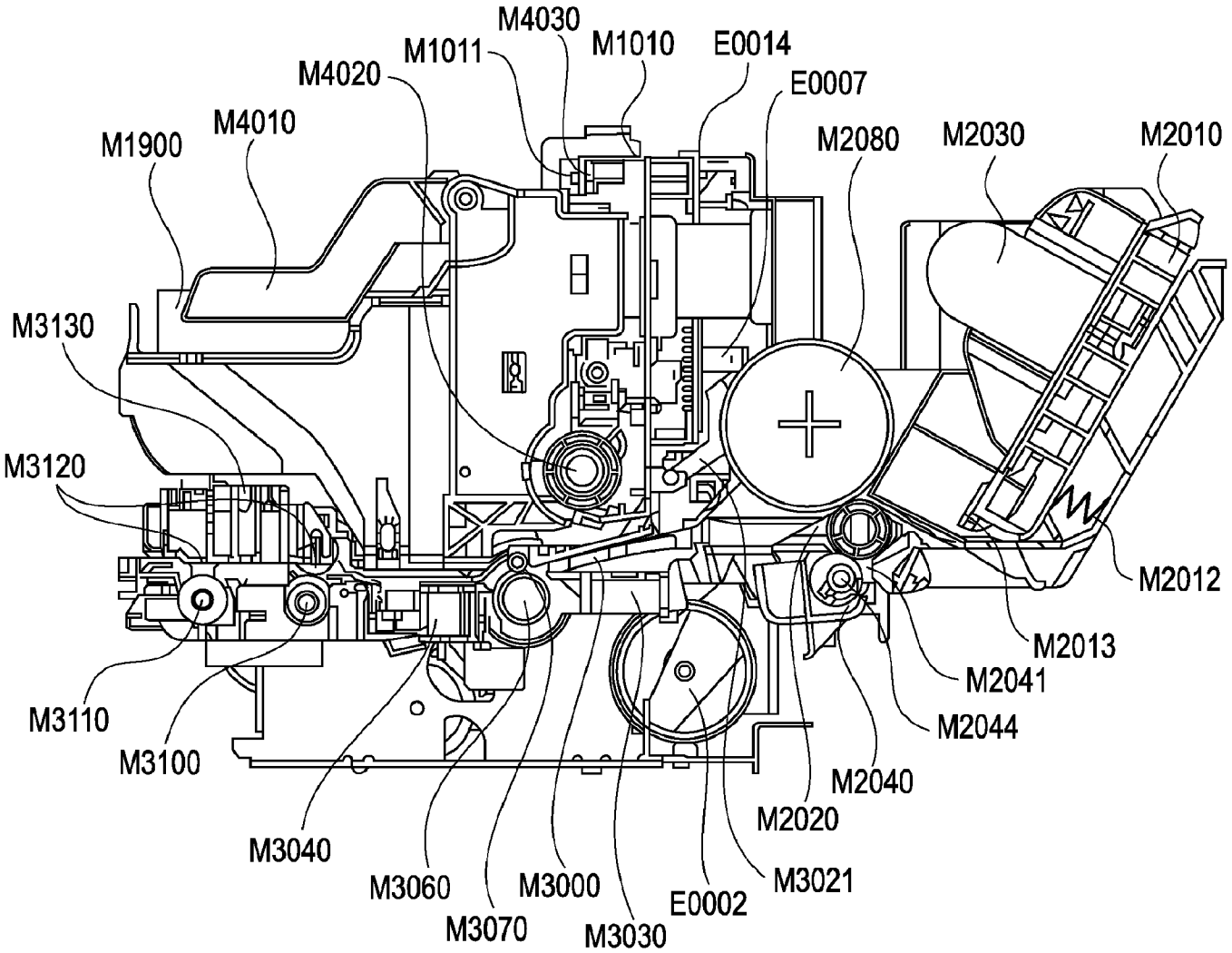
FIG. 4 is a cross-sectional view illustrating the internal configuration of the apparatus body of the inkjet recording apparatus according to the embodiment.

The sheet feeding operation from the sheet feeder is performed in a state where a recording medium is bent since a path through which the recording medium travels until reaching the pinch roller group is bent, as shown in FIG. 4. Therefore, if a recording medium with a thickness of about 0.5 mm or greater is to be fed from the sheet feeder, there may be a case where the sheet feeding operation cannot be performed due to an increase in feed resistance caused by a reactive force produced by the bent recording medium. Even if the sheet feeding operation is possible, the recording medium would remain bent after being ejected or may even break.

Flat-pass recording is a kind of recording that is performed on a recording medium that is undesirably bent, such as a thick recording medium, or a recording medium that is unbendable, such as a CD-R.

Flat-pass recording includes a type of recording in which a recording medium is manually fed through a slit in the rear surface of the apparatus body (below the sheet feeder) until the recording medium is nipped by the pinch rollers in the apparatus body. However, the flat-pass recording in this embodiment is of a type in which a recording medium is fed to the recording position through an ejection slit at the front of the apparatus body and the recording is performed after a switch-back operation.

Referring to FIG. 1, a front cover M7010 is located below the sheet ejector so as to serve as a tray for stacking several tens of recording media having undergone normal recording. Therefore, the front cover M7010 will be referred to as "front tray M7010" hereinafter. When performing flat-pass recording, the front tray M7010 is lifted to the position of the ejection slit so that a recording medium can be fed horizontally into the ejection slit in a direction opposite to the normal conveying direction, as shown in FIG. 5. The front tray M7010 is provided with, for example, a hook (not shown) that allows the front tray M7010 to be securable in a flat-pass feed position. Detection of the front tray M7010 in the flat-pass feed position is possible with a sensor, and the apparatus can be determined to be in a flat-pass recording mode on the basis of this detection result.

In a flat-pass recording mode, a flat-pass key E3004 is first operated in order to place a recording medium on the front tray M7010 and insert the recording medium into the ejection slit. Then, a mechanism (not shown) lifts the spur-roller holder M3130 and the pinch-roller holder M3000 to a position higher than the estimated thickness of the recording medium. By pressing a rear-tray button M7110, a rear tray M7090 is drawn out and a rear subtray M7091 can also be drawn out into a V-shape (see FIG. 6). The rear tray M7090 and the rear subtray M7091 are for supporting a long recording medium at the rear side of the apparatus body since a long recording medium, when inserted from the front side of the apparatus body, protrudes from the rear side of the apparatus body. When performing recording on a thick recording medium, the recording medium may become scraped against the recording-head face unless the recording medium maintains a flat orientation, or the recording quality may possibly be adversely affected if the conveying load changes. Therefore, the arrangement of these trays is advantageous. In contrast, it is not necessary to draw out the rear tray M7090 and the like if the recording medium has a length such that it does not protrude from the rear side of the apparatus body.

In the above-described manner, a recording medium can be inserted into the apparatus body through the ejection slit. The recording-medium conveying operation during the flat-pass mode will now be described with reference to FIG. 7. First, a recording medium is placed on the front tray M7010 such that the trailing end (i.e., the end closest to the user) and the right edge of the recording medium are aligned with marker positions on the front tray M7010.

When the flat-pass key E3004 is operated again, the spur-roller holder M3130 is lowered so as to cause the eject rollers M3100 and M3110 and the spur rollers M3120 to nip the recording medium. Subsequently, the eject rollers M3100 and M3110 draw the recording medium into the apparatus body by a predetermined amount (in the opposite direction of the normal-recording conveying direction). Since the closer end (i.e., trailing end) of a recording medium, which may be short in length, is already aligned with a marker position when the recording medium is first set, the leading end (i.e., the end farthest from the user) of the short recording medium may sometimes not reach the conveying roller M3060. Therefore, a predetermined amount is set equivalent to a distance that allows the trailing end of an assumedly shortest recording medium to reach the conveying roller M3060. When a recording medium conveyed by the predetermined amount reaches the conveying roller M3060, the pinch-roller holder M3000 is lowered at that position so as to cause the conveying roller M3060 and the pinch roller group M3070 to nip the recording medium. This completes the feeding operation of the recording medium for flat-pass recording (recording standby position).

A nipping force by the eject rollers M3100 and M3110 and the spur rollers M3120 is set to a relatively small value so as not to adversely affect a formed image when a recording medium is being ejected during normal recording. Therefore, when performing flat-pass recording, there is a possibility that the recording medium may become positionally shifted before the actual recording. In contrast, in this embodiment, the conveying roller M3060 and the pinch roller group M3070 with a relatively large nipping force are used for nipping the recording medium so that the set position of the recording medium can be maintained. Furthermore, when the recording medium is being conveyed into the apparatus body by the predetermined amount, the trailing-end position of the recording medium (which acts as the leading-end position during recording) can be detected using a flat-pass sheet detecting sensor M3170 disposed between the platen M3040 and the spur-roller holder M3130.

When the recording medium is set at the recording standby position, a recording command is executed. Specifically, the recording medium is conveyed by the conveying roller M3060 to the recording position of the recording head 4, and recording is subsequently performed in the same manner as normal recording. After the recording, the recording medium is ejected onto the front tray M7010.

If another flat-pass recording is desired, the recording medium having undergone the recording is taken out of the front tray M7010 and a subsequent recording medium is set thereon, and then the above-described process may be repeated again. Specifically, by pressing the flat-pass key E3004, the spur-roller holder M3130 and the pinch-roller holder M3000 are lifted and a new recording medium is set on the front tray M7010.

On the other hand, when ending the flat-pass recording mode, the apparatus can be switched back to the normal recording mode by returning the front tray M7010 to its normal recording position.

F. Electric Circuit Configuration

Figure 9:
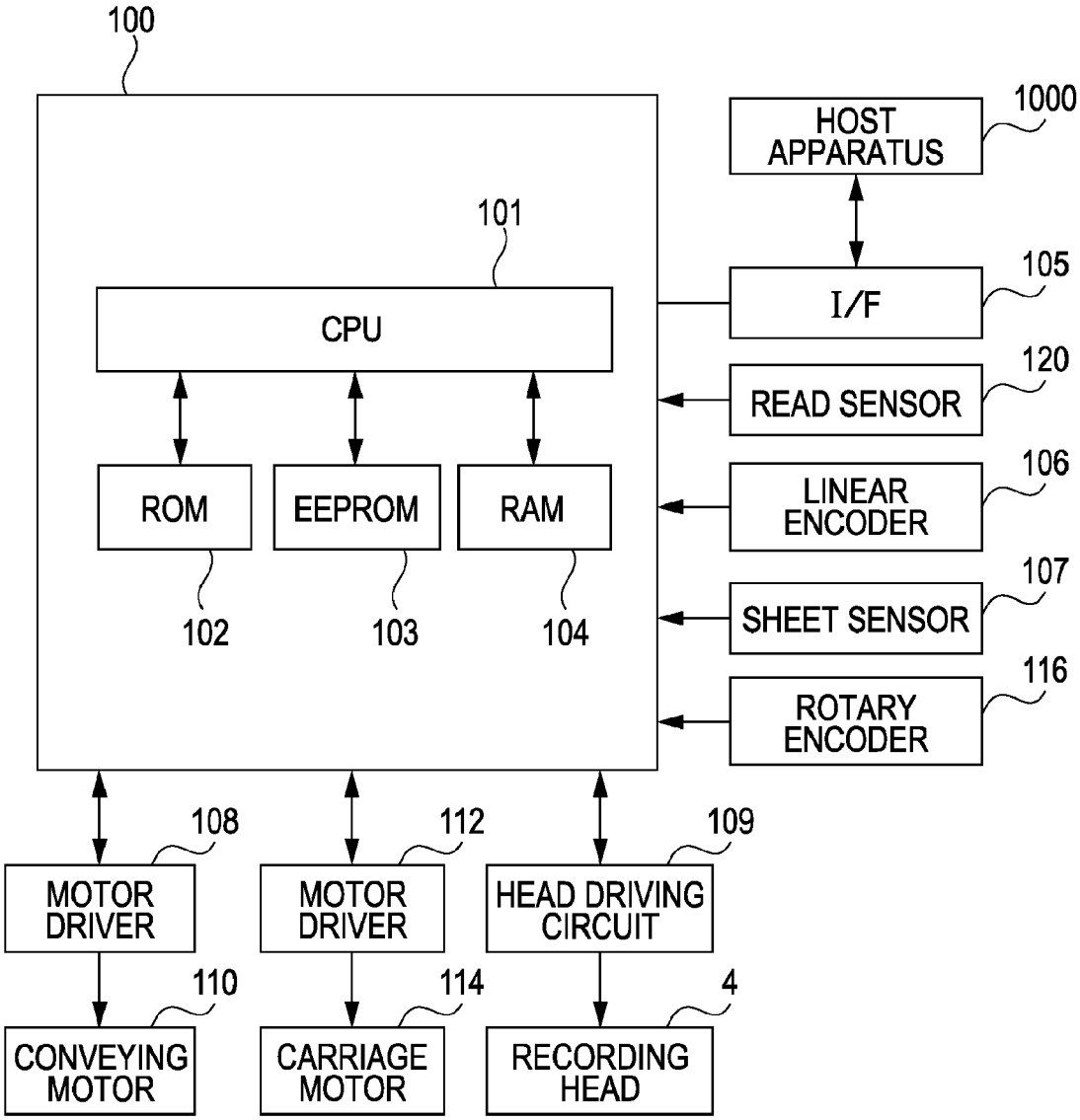
FIG. 9 is a block diagram illustrating a configuration example of a relevant portion of a control system in the inkjet recording apparatus according to the embodiment.

FIG. 9 illustrates a configuration example of a relevant portion of a control system in the recording apparatus. Reference numeral 100 denotes a control unit that controls drivers included in the recording apparatus. The control unit 100 includes a CPU 101, a ROM 102, an EEPROM 103, and a RAM 104. The CPU 101 is configured to perform various calculations and determinations for processing related to the recording operation and the like, including a process to be described later, as well as processing related to recording data. The ROM 102 stores programs corresponding to the processing to be executed by the CPU 101, as well as other fixed data. The EEPROM 103 is a nonvolatile memory used for holding predetermined information when the recording apparatus is turned off. The RAM 104 is configured to temporarily store recording data supplied from an external source, as well as recording data rendered in accordance with the apparatus configuration, and also to function as a work area for a calculation process to be performed by the CPU 101.

An interface (I/F) 105 is connected to an external host apparatus 1000 and performs bidirectional communication with the host apparatus 1000 on the basis of a predetermined protocol. The host apparatus 1000 is a computer or other known type of apparatus and serves as a supply source of recording data to be used for the recording operation in the recording apparatus according to this embodiment. In the host apparatus 1000, a printer driver, which is a program for causing the recording apparatus to perform recording, is installed. In other words, the printer driver sends out recording setting information, including recording data and classification information of a recording medium onto which the recording data is to be recorded, as well as a control command for controlling the operation of the recording apparatus.

A linear encoder 106 is configured to detect the position of the recording head 4 in the main scanning direction. A sheet sensor 107 is provided at an appropriate position on the recording-medium conveyance path. By detecting the leading end and the trailing end of a recording medium using this sheet sensor 107, a conveyance position of the recording medium in the sub scanning direction can be ascertained. The control unit 100 is connected with motor drivers 108 and 112 and a head driving circuit 109. Under the control of the control unit 100, the motor driver 108 drives a conveying motor 110 serving as a driving source for conveying a recording medium. A driving force of the conveying motor 110 is transmitted to the conveying roller M3060 and the eject rollers M3100 and M3110 via a transmission mechanism such as gears. The motor driver 112 drives a carriage motor 114 serving as a driving source for moving the carriage 7. A driving force of the carriage motor 114 is transmitted to the carriage 7 via a transmission mechanism such as a timing belt. Under the control of the control unit 100, the head driving circuit 109 drives the recording head 4 so as to cause the recording head 4 to perform a discharging operation. A rotary encoder 116 is attached to the shaft of the conveying roller M3060 and is configured to detect the rotational position and the speed thereof so that the conveying motor 110 can be controlled.

Characteristic Feature of this Embodiment

An overview of conveyance control, which is a characteristic feature in the recording apparatus according to this embodiment, will be provided below. First, in this embodiment, when the recording medium disengages from the nip portion of the conveying roller M3060, the rotation of the conveying roller and the eject rollers, that is, the driving of the motor, is controlled by using a first correction value for setting a roller peripheral-speed ratio between the conveying roller and the eject rollers to 1. Moreover, regarding the rotational phase of the conveying roller and the eject rollers when the roller peripheral-speed ratio is a maximum value or a minimum value, a second correction value for adjusting the initial phase of the conveying roller and the eject rollers is used so as to cause the recording medium to disengage from the nip portion of the conveying roller.

In this embodiment, the conveying amount is controlled using the first and second correction values so as to stabilize the conveying amount at a timing at which the recording medium disengages from the conveying roller and to thus reduce degradation of the recording quality.

Furthermore, the recording apparatus according to this embodiment is configured to switch between a first conveyance control mode, in which the conveying amount is controlled using both the first correction value and the second correction value, and a second conveyance control mode, in which the conveying amount is controlled using only the first correction value, in accordance with the recording-medium conveyance path. Thus, in a recording apparatus having a plurality of conveyance paths, the conveying amount at the timing at which the recording medium disengages from the conveying roller can be stabilized.

A detailed description of conveyance control, which is a characteristic feature of this embodiment, will be provided below.

1. Procedure for Acquiring Conveying-Amount Correction Values

In this embodiment, the roller perimeter of each roller is segmented into 110 blocks, and a conveying-amount correction is performed by acquiring a conveying-amount correction value for each of the 110 blocks in order to compensate for an error in the conveying amount of every rotational phase of a roller caused by eccentricity thereof.

Figure 10:
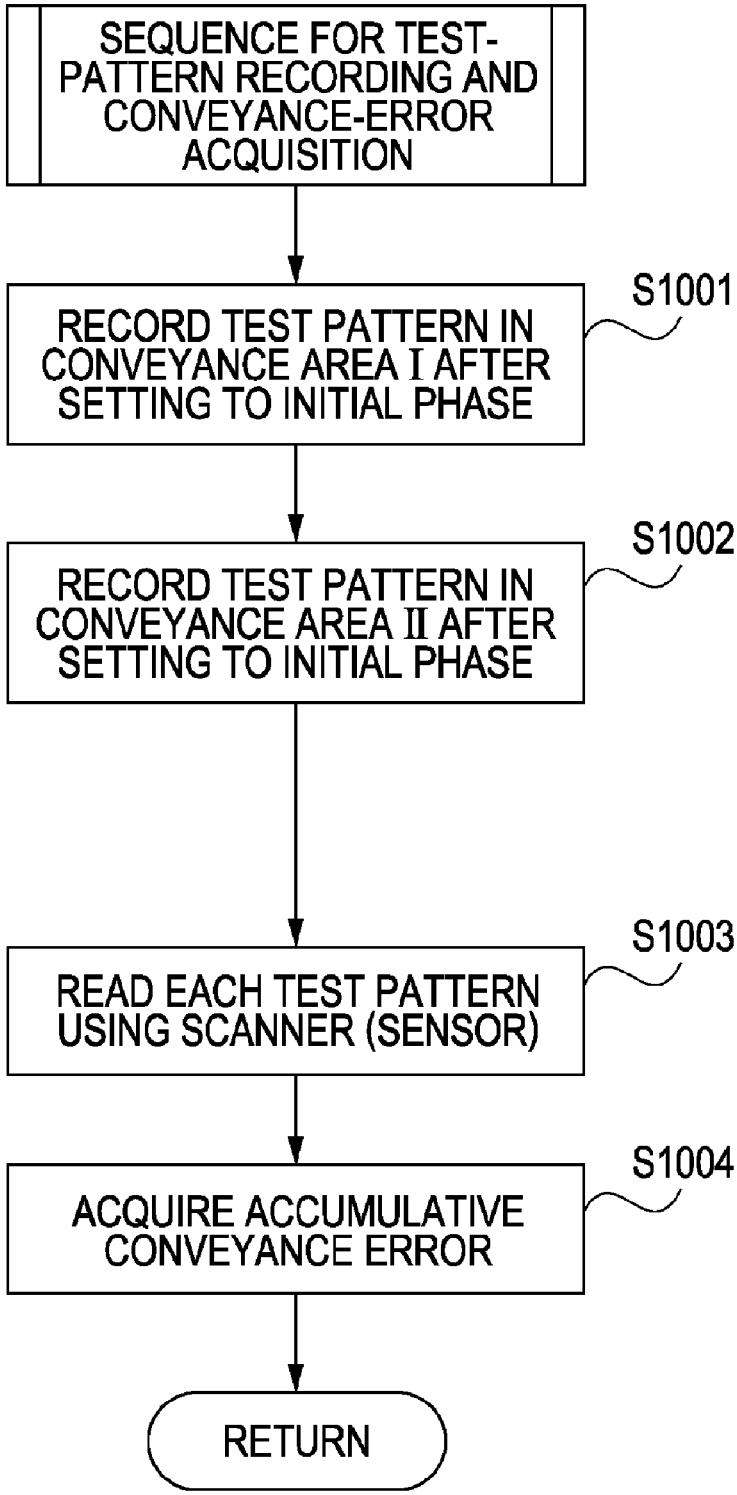
FIG. 10 is a flow chart showing an example of a procedure for recording test patterns and acquiring a conveyance error in the embodiment.

FIG. 10 is a flow chart showing an overview of a procedure for acquiring conveying-amount correction values. In step S1001 of this procedure, a preparation for commencing a recording operation, including positioning and feeding of a recording medium, is performed, and when the recording medium is conveyed to a predetermined recording position, a test pattern is recorded thereon in a conveyance area I. In step S1002, the recording medium is conveyed further, and a test pattern is recorded thereon in a conveyance area II.

In step S1003, each test pattern is read using a read sensor 120 so as to acquire density information of the test pattern. In step S1004, based on this density information, an accumulative conveyance error is detected so as to acquire a conveying-amount correction value.

Detailed descriptions of the test patterns and the conveyance areas will be provided below.

2. Detailed Description of Test Patterns

Figure 11:
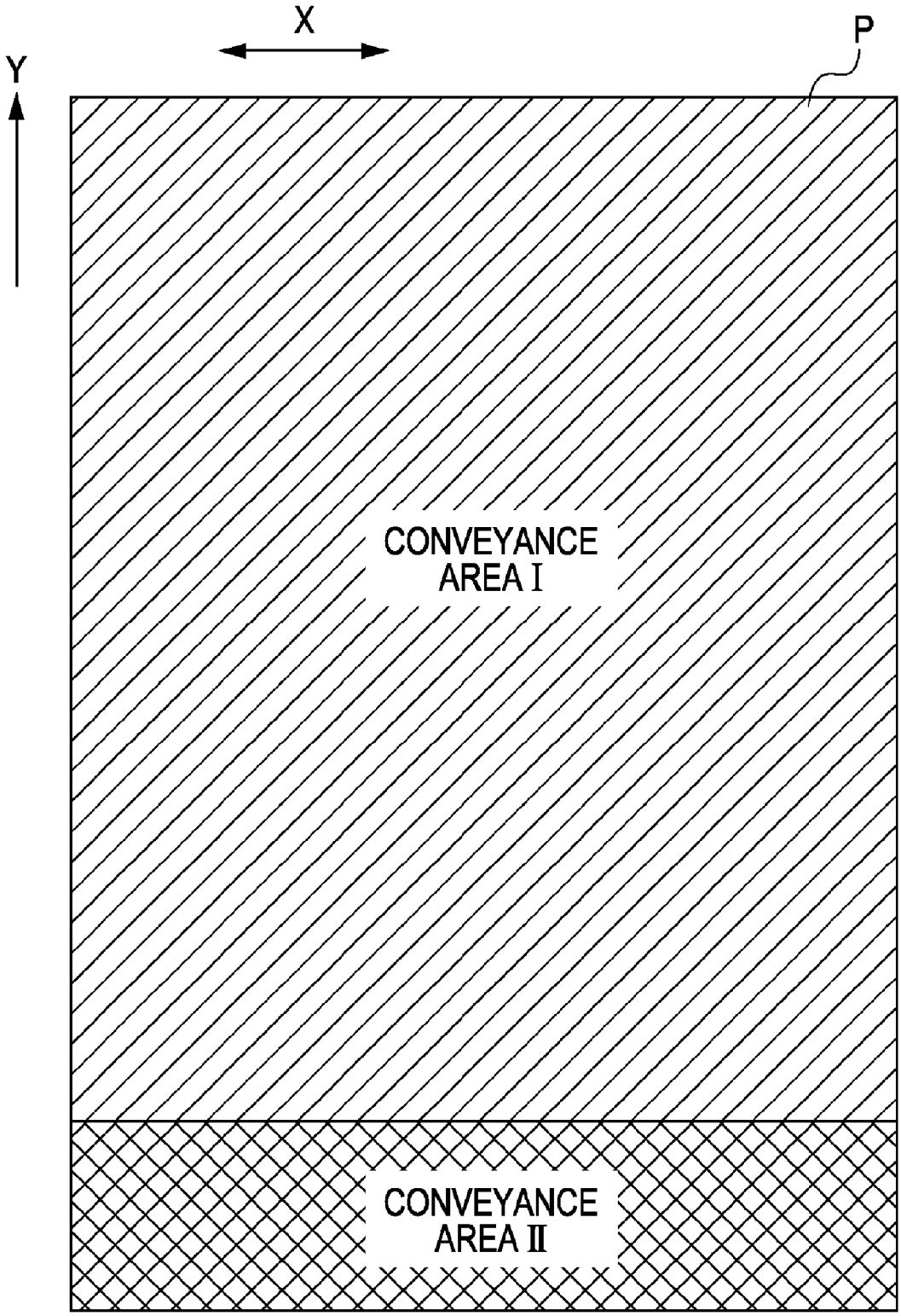
FIG. 11 illustrates conveyance areas in the embodiment.

First, two conveyance areas divided in a conveying direction Y in this embodiment will be described with reference to FIG. 11. In this embodiment, the conveyance area I corresponds to an area on which recording is performed when the recording medium is conveyed using only the conveying roller, as well as an area on which recording is performed when the recording medium is conveyed using both the conveying roller and the eject rollers. On the other hand, the conveyance area II corresponds to an area on which recording is performed when the recording medium is conveyed using only the eject rollers. Since the conveying roller is the more dominant roller for conveying a recording medium as compared with the eject rollers, in this embodiment, a conveyance area for when only the conveying roller is used and a conveyance area for when both the conveying roller and the eject rollers are used are categorized as the same conveyance area I.

Figure 12:
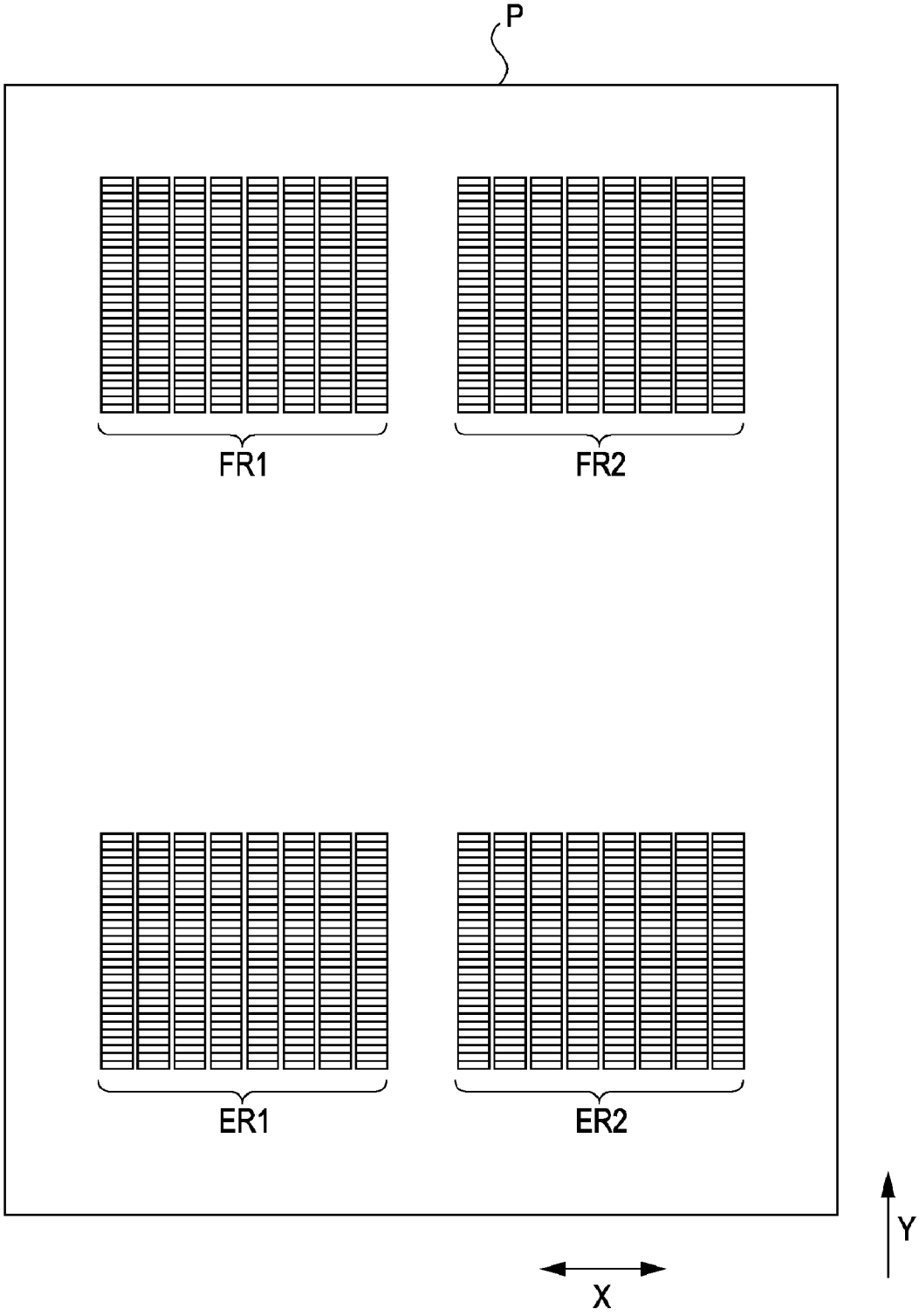
FIG. 12 illustrates an example of test patterns used in the embodiment.

Next, test patterns used in this embodiment are shown in FIG. 12. The test patterns used in this embodiment are recorded onto the conveyance areas I and II. Furthermore, test patterns for detecting conveyance errors of the rollers are arranged side by side at a position close to a conveyance reference and at a position distant from the conveyance reference, as viewed in a rotation-axis direction X of each roller (i.e., main scanning direction of the recording head 4).

Specifically, in FIG. 12, test patterns FR are test patterns to be recorded in the conveyance area I and include a test pattern FR1 located close to the conveyance reference and a test pattern FR2 located distant from the conveyance reference. On the other hand, test patterns ER are test patterns to be recorded in the conveyance area II and include a test pattern ER1 located close to the conveyance reference and a test pattern ER2 located distant from the conveyance reference.

When the test patterns ER1 and ER2 are to be recorded, the pinch rollers M3070 are released after the test patterns FR1 and FR2 are recorded so that the recording medium can be set in a state where it can be conveyed using only the eject rollers. Thus, a recordable area for the test patterns ER1 and ER2 can be sufficiently ensured.

The four test patterns to be recorded onto a recording medium will now be described.

Each of the test patterns is recorded using the second-black nozzle array H3500 and has a total of 240 patches, which include 30 patches in the conveying direction Y by 8 patches in the scanning direction X. When recording these patches, a predetermined image is recorded by performing a first recording scan using 128 upstream-side nozzles of 640 central nozzles included in a nozzle array having 768 nozzles. Then, after performing a conveying process equivalent to 128 nozzles four times, a second recording scan is performed on the aforementioned predetermined image using 128 downstream-side nozzles of the aforementioned 640 nozzles, thereby completing the patches. Eight of the patches arranged in the scanning direction X are recorded by shifting the nozzle usage range by one nozzle downstream in the conveying direction in the second scan, as viewed from left to right in the drawing. The shifting range is between −3 to +4 with a positive value indicating shifting towards upstream.

In this embodiment, the nozzle array H3500 includes nozzles arranged at a pitch of 1200 dpi, and one ideal conveying amount (i.e., conveying amount between two scanning processes of the recording head 4) is equal to a distance equivalent to a range of 128 nozzles (128/1200×25.4 = 2.709 (mm)). If a conveying process is performed with an ideal conveying amount, when the shift amount is "0", an image to be recorded in a fifth main scanning process after four recording-medium conveying processes is made to exactly overlie a predetermined image recorded in the first scan.

A positive shift amount has a greater conveying amount than the distance thereof, whereas a negative shift amount has a smaller conveying amount. If an image recorded using the upstream-side nozzle group for the first scan and an image recorded using the downstream-side nozzle group for the second scan overlie each other, areas with no recorded dots form within the images, resulting in reduced density (OD value). On the other hand, if the images recorded in the first scan and the second scan are deviated from each other due to an error in the conveying amount, the blank areas are filled with dots, resulting in higher density.

In this embodiment, the recording-medium conveying amount (ideal value) between main scanning processes is set to 2.709 mm, and 30 main scanning processes are repeated so that 30 patches are formed over a range in the sub scanning direction (conveying direction). Therefore, the length of one test pattern in the sub scanning direction is 2.709×30=81.27 mm (ideal amount), which is equivalent to a little over two perimeters of a roller when the roller used is of a typical one having a perimeter of 37.19 mm.

Assuming that 8 patches arranged in the scanning direction constitute one patch group, the 30 patch groups arranged in the conveying direction Y are formed by varying the roller area used in a recording-medium conveying process performed between a first recording scan and a second recording scan. Supposing that the recording-medium conveying process after a first recording scan for an upstream-most patch group in the conveying direction is performed from a reference position, an area (0 to 10.836 mm) equivalent to four recording-medium conveying processes from the roller reference position is used for the recording of the upstream-most patch group. For a second patch group from upstream, an area (2.709 to 13.545 mm) equivalent to four recording-medium conveying processes from a position distant from the roller reference position by 2.709 mm is used. Similarly, for a third patch group, a roller area (5.418 to 18.963 mm) is used, and for a fourth patch group, a roller area (8.127 to 21.672 mm) is used. In this manner, different roller areas are used for the respective patch groups from the first scan to the second scan.

3. Acquisition of Conveyance Error

After reading each test pattern recorded in the above-described manner using a scanner and detecting the density of all of the patches, the densities of the multiple patches recorded in the main scanning direction are compared. Then, the shift amount of a patch with the lowest density in each patch group can be acquired as a conveyance error. The conveyance error in this case is calculated as an accumulative conveyance error (accumulation of four conveying processes) between the first scan and the second scan for pattern recording. An accumulative conveyance error is preferably standardized in accordance with a certain reference length. In this embodiment, a calculation is carried out by multiplying the conveyance error in the four conveying processes (accumulation equivalent to 640 nozzles) by 768/640 so as to determine an accumulative conveyance error corresponding to a nozzle-array length (equivalent to 640 nozzles).

4. Correction-Value Acquisition

Figure 13:
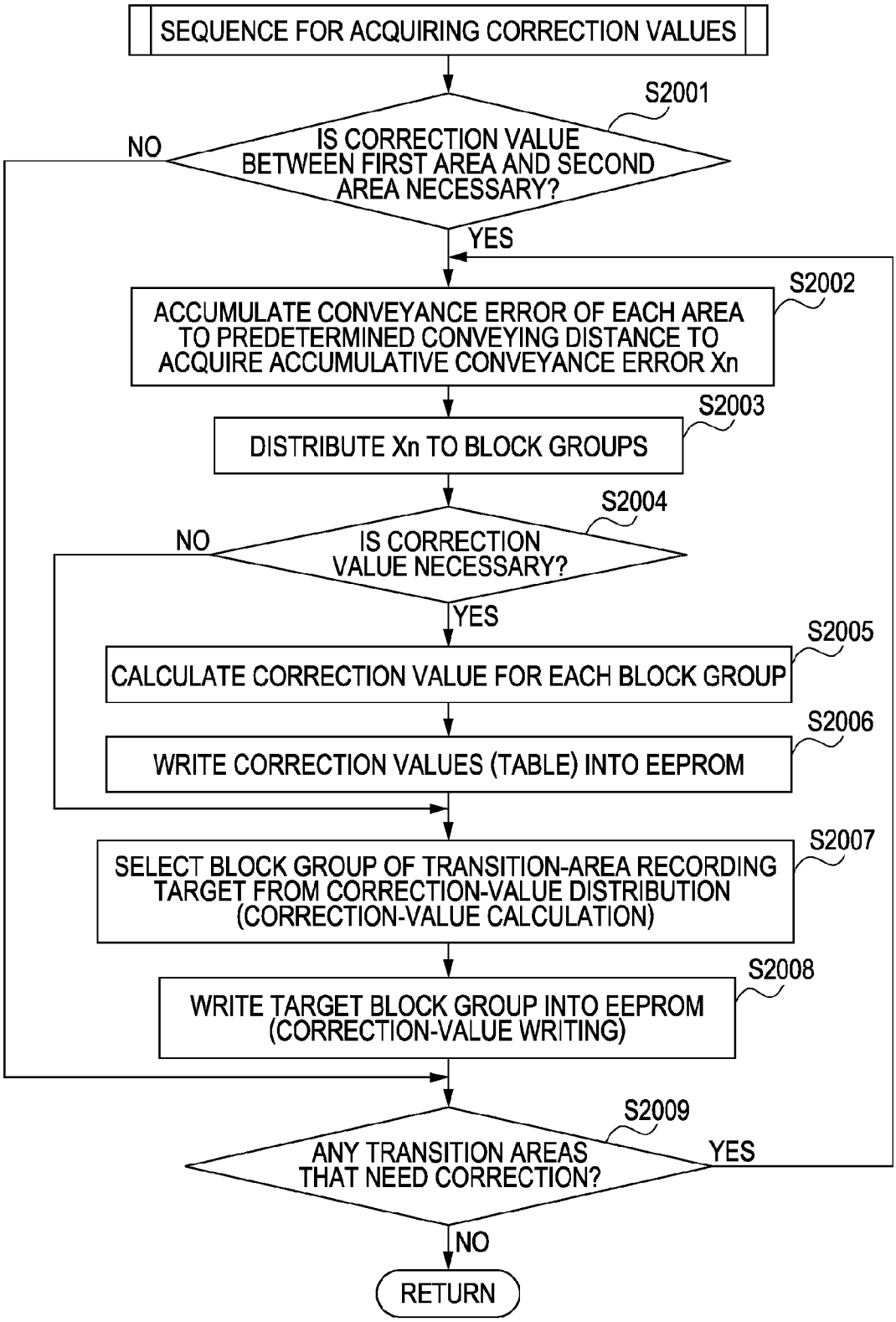
FIG. 13 is a flow chart showing an example of a procedure for correction-value acquisition in the embodiment.

First, a procedure for correction-value acquisition will be described below with reference to FIG. 13.

In step S2001, it is determined whether or not to correct the conveying amount between the conveyance areas I and II (at a timing at which the trailing end of the recording medium disengages from the conveying roller). If a correction is necessary, the process proceeds to step S2002 where an accumulative conveyance error $X_n$ between the conveyance areas I and II is acquired. Then, in step S2003, this accumulative conveyance error $X_n$ is distributed to each of the blocks allocated to each roller. If it is determined in step S2004 that acquisition of a first correction value is necessary, the process proceeds to steps S2005 and S2006. A first correction value is acquired for each of the blocks in step S2005 and is then written into the EEPROM 103 in step S2006. Subsequently, a second correction value is acquired on the basis of the distribution of the first correction value in step S2007 and is written into the EEPROM 103 in step S2008. In step S2009, it is determined whether or not there is still an area that requires acquisition of a correction value. Finally, the process ends.

The correction-value acquisition will be described below in detail.

By performing the process described in the paragraphs above related to the acquisition of a conveyance error, an accumulative conveyance error equivalent to a nozzle-array length is acquired in correspondence to each patch group in a test pattern. In this embodiment, since one ideal conveying amount is equal to 2.709 mm, 30 accumulative conveyance errors are acquired at intervals of 2.709 mm. At the start of test-pattern recording, the initial phase of the rollers involved in recording-medium conveyance is acquired. Although a roller-phase detecting sensor is attached only to the conveying roller M3060, and the conveying roller M3060 and the first eject roller M3100 have slightly different roller diameters in this embodiment, these rollers are driven synchronously since the gears that drive both rollers have the same number of gear teeth. On the other hand, since the first eject roller M3100 and the second eject roller M3110 have the same roller diameter, these eject rollers are also driven in synchronization with each other. Therefore, the phase of the first eject roller M3100 and the second eject roller M3110 can be estimated from the phase of the conveying roller M3060. Even in a configuration where the conveying roller and the two eject rollers have the same roller diameter, since all of the rollers are driven in synchronization with each other, a phase detector is necessary for only one of the rollers. In an apparatus in which there are no rollers driven in synchronization with each other, a phase detector needs to be provided for each of the rollers.

In the conveying-amount correction according to this embodiment, each roller is segmented into 110 blocks, and the conveying amount is corrected for each of these blocks. The rotary encoder 116 attached to the conveying roller M3060 is configured to output 14,080 pulses per rotation. The 14,080 pulses are divided into 128 pulses in accordance with the 110 blocks, so that the position (phase) of the current roller can be detected in accordance with the output pulses from the rotary encoder 116.

Figure 14:
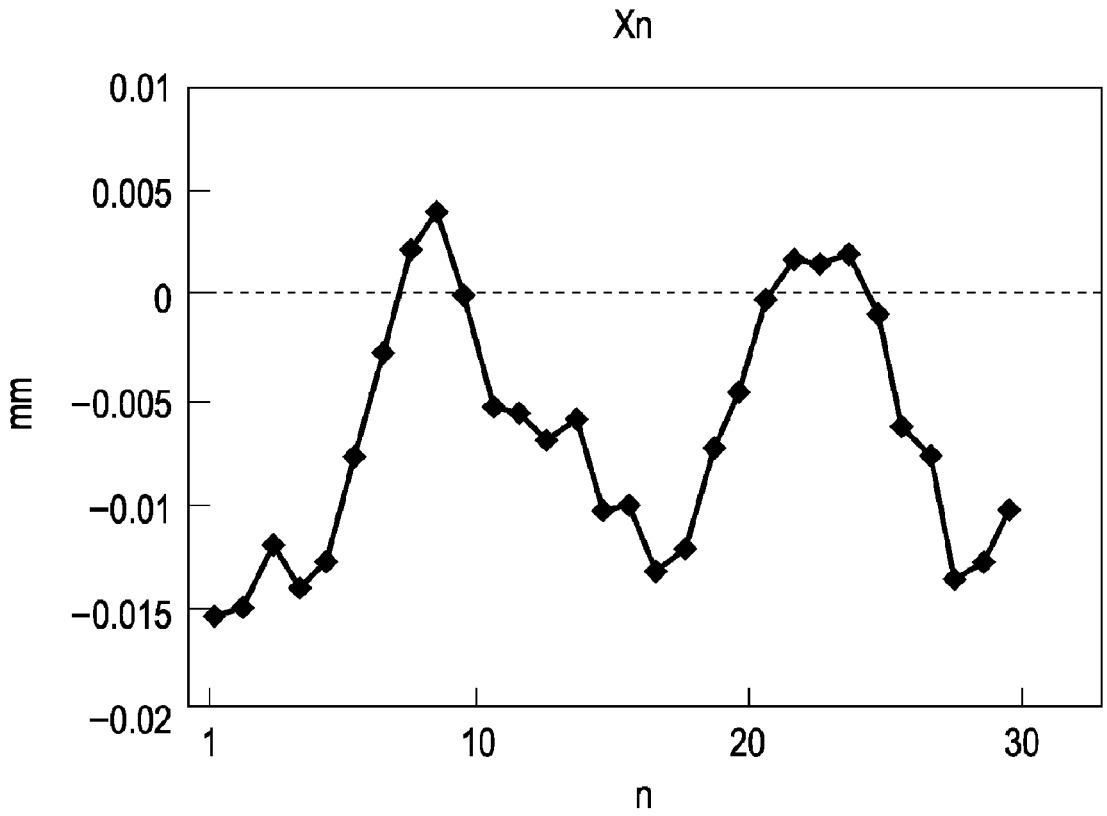
FIG. 14 is a graph showing conveyance errors converted to numerical values on the basis of density information acquired from one test pattern.

FIG. 14 is a graph in which an accumulative conveyance error $X_n$ is plotted for each of the patch groups detected from two of the test patterns in the conveyance area I. In this graph, the patch groups are numbered as n=1, 2, and so on, starting from the upstream-side patch group in the conveying direction. An accumulative conveyance error is calculated as an average value of an accumulative conveyance error $X_{nH}$ and an accumulative conveyance error $X_{nA}$ respectively at the conveyance-reference side and the non-conveyance-reference side. Alternatively, an accumulative conveyance error may be a numerical value calculated while weighting a roller with respect to a left-right difference (effect in the rotation-axis direction) or an effect of warping of the roller.

In FIG. 14, the abscissa axis represents the number n of each patch group, which corresponds to an accumulative conveying amount from the initial phase. In other words, n corresponds to a conveying amount from the reference position of a roller. When n=1, the conveying amount is 2.709 mm, and when n=2, the conveying amount is 5.419 mm.

FIG. 15 is a table showing the distribution of accumulative conveying amounts and phase blocks corresponding to the individual patch groups. An accumulative conveying amount is a conveying amount from the reference position of a roller and is equal to 2.709 mm when n=1 and equivalent to one perimeter of the roller when n=14. Of the 110 blocks, the initial phase when recording a test pattern in the conveyance area I corresponds to a "17th block" counted from the reference position, and the initial phase when recording a test pattern in the conveyance area II corresponds to a "73th block" counted from the reference position. Furthermore, by distributing an accumulative conveying amount to 8 blocks for each patch group and to 6 blocks for the last patch group of one cycle, distribution as shown in FIG. 15 can be obtained. In detail, an n=1 patch group corresponds to 17th to 24th blocks, an n=2 patch group corresponds to 25th to 32th blocks, . . . , and an n=14 patch group corresponds to 11th to 16th blocks.

Since the length of each test pattern in this embodiment is equivalent to a little over two perimeters of a roller as mentioned above, the distribution described above is repeated for n=15 and onward. With regard to patch groups n with repetitive block distribution, an average value of conveyance errors is calculated so that a conveyance error can be set unambiguously. As for the conveyance area II, the distribution process is the same as that for the conveyance area I except for the fact that the initial phase is different therefrom.

In this embodiment, as shown in FIG. 16, the 17th to 24th blocks are defined as a block group A, the 25th to 32nd blocks are defined as a block group B, . . . , and the 11th to 16th blocks are defined as a block group N. If conveyance errors for one roller perimeter or greater cannot be acquired at once due to the characteristic of a test pattern, the test pattern may be recorded dividedly onto multiple recording media with different initial phases so that conveyance errors for one roller perimeter can be acquired. As another alternative, a unit configured to predict the distribution of conveyance errors for one perimeter may be used.

A method of calculating a first correction value and a second correction value used for stabilizing the conveying operation when a recording medium disengages from the conveying roller M3060 will now be described.

In this embodiment, a first correction value is calculated for each combination of block groups (rotational phases) for the conveyance areas I and II. Specifically, with regard to all of the combinations of the block groups, a first correction value is preliminarily calculated so that a peripheral-speed ratio with respect to the conveying amounts for the conveyance area I and the conveyance area II is set to 1. In consequence, a stable conveying operation can be achieved whether the rotational phases of the conveying roller M3060 and the eject roller M3100 and M3110 take any values when the recording medium disengages from the nip portion of the conveying roller M3060.

In detail, in order to allow a conveying amount to include a conveyance error corresponding to conveyance of a 16-nozzle width, a roller peripheral speed $V_r$ is determined by dividing a conveyance error $X_n$, converted based on a 768-nozzle length, by 48 and then subtracting the resultant quotient from an ideal conveying amount, as shown in the following formula 1:

$$V_r=(16/1200\times 25.4)-(-X_n/48) \quad (1)$$

A first correction value ($Z_n$) can be calculated from the following formula 2:

$$Z_n=[(V_r(II) \text{ for Conveyance Area } II)/(V_r(\mathrm{I}) \text{ for Conveyance Area } I)-1]*100 \quad (2)$$

Figure 18:
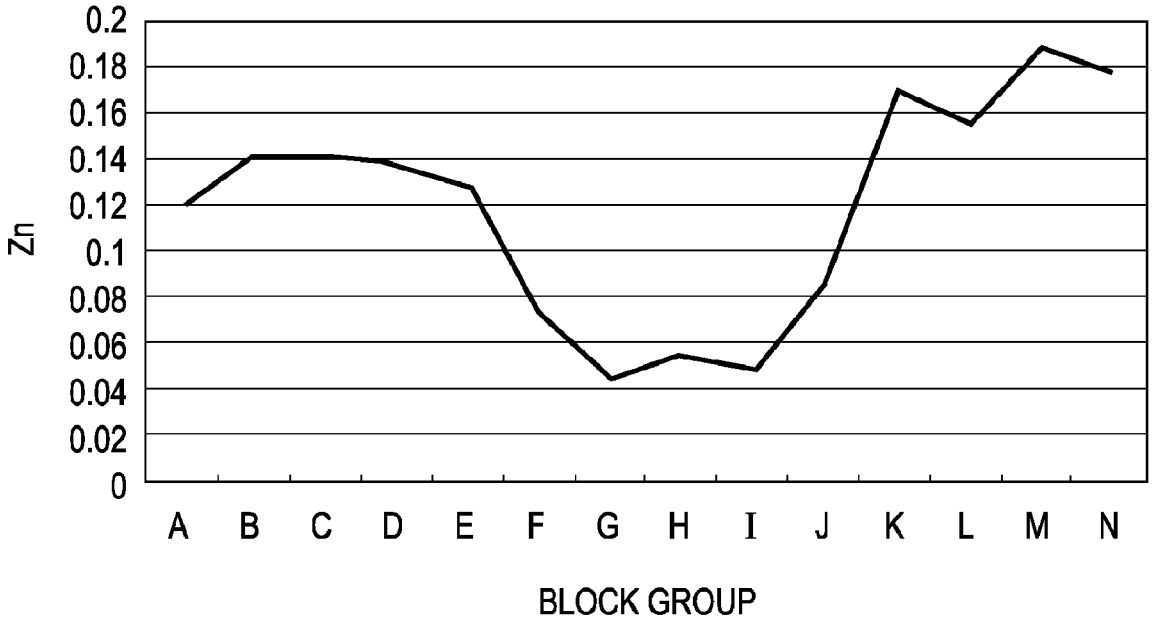
FIG. 18 is a graph showing the distribution of first correction values ($Z_n$) in the respective block groups between the adjacent areas I and II.

FIG. 18 illustrates the distribution of first correction values ($Z_n$). The distribution is a periodic function and has a maximum value and a minimum value.

Regarding the rotational phase of the conveying roller and the eject rollers when the roller peripheral-speed ratio is a maximum value or a minimum value, a second correction value for adjusting the initial phase of the conveying roller and the eject rollers so as to cause the recording medium to disengage from the nip portion of the conveying roller is calculated. By controlling the conveying operation using such a second correction value, even when variations in the conveying amount occur, the fluctuation width of the conveying amounts can be minimized. In this embodiment, the second correction value is used to adjust the initial roller phase in accordance with the size of the recording medium in the sub scanning direction so as to cause the recording medium to disengage from the nip portion of the conveying roller at a block group in which the roller peripheral-speed ratio reaches its minimum.

5. First Conveyance Control Mode

In this embodiment, when a sheet feeding operation from an auto sheet feeder serving as a feeding conveyance path is selected in response to a recording command received from the host apparatus 1000, the size of a recording medium on which recording is to be performed and the recording mode are read. In this embodiment, in order to achieve the distribution of first correction values ($Z_n$) between the conveyance areas I and II as shown in FIG. 18, the initial phase of each roller is adjusted so as to cause the recording medium to disengage from the nip portion of the conveying roller M3060 at a block group G with the minimum $Z_n$. To achieve this, for each recording medium and each recording mode, the recording apparatus according to this embodiment has a pulse-number offset value (second correction value), which incorporates a conveyance correction value based on the size of the recording medium and the recording mode, in the EEPROM 103. The offset value is added in the reverse direction of the roller from a position corresponding to 68×128=8704 pulses with respect to a central block "68", which is the origin point, of each block group so that a pulse value for the initial phase is determined. When the phase-detection optical sensor confirms that the conveyance starting position (initial phase) of the roller is adjusted to this pulse value, the sheet feeding operation commences, and the recording operation is carried out until the trailing end of the recording medium passes the PE sensor E0007.

Furthermore, when the trailing end of the recording medium passes the PE sensor E0007, the roller phase at the time of passing is calculated. Although a timing at which the trailing end of the recording medium disengages from the roller is predicted on the basis of the timing at which the trailing end passes the PE sensor E0007 in this embodiment, the prediction may alternatively be made at an initial-phase adjustment point prior to the sheet feeding operation. However, considering an adverse effect that may occur when the phase predicted on the basis of, for example, slippage of the recording medium relative to the roller is shifted, it is preferable that the trailing end of the recording medium be predicted on the basis of the timing at which the trailing end passes the PE sensor E0007.

Supposing that the distance from the PE sensor E0007 to the nip portion between the conveying roller M3060 and the pinch roller group M3070 is 14.16 mm, the distance is equivalent to 5361 pulses when converted to the number of pulses of the rotary encoder 116. Supposing that the phase of the conveying roller M3060 is "10" when the trailing end of the recording medium passes the PE sensor E0007, the phase is equivalent to 1280 pulses when converted to the number of pulses. Therefore, 6641 pulses are required during forward rotation of the roller for conveyance until the trailing end of the recording medium disengages from the roller. When converted to phase block, this is equivalent to block "52", which corresponds to the block group E. Then, the first correction value corresponding to the block group E is applied. As the result of adjusting the initial phase based on the second correction value in this manner, the trailing end of the recording medium is made to disengage from the roller at the block group E that is close to the block group G in which the first correction value ($Z_n$) is at the minimum $Z_n$. Furthermore, a stable conveying operation can be achieved by using the first correction value for correcting the conveyance error when the trailing end of the recording medium disengages from the nip portion of the conveying roller M3060, that is, when switching from the conveyance area I to the conveyance area II. It is needless to say that if there is no slippage of the recording medium relative to the roller, the trailing end of the recording medium is made to disengage from the roller at the block group G.

With regard to conveyance control performed when the leading end of the recording medium enters the nip portion between the eject rollers and the spur rollers, the phase at the time of entry may be predicted from the phase during the sheet feeding operation, and the second correction value for correcting the roller peripheral-speed ratio between the conveyance areas before and after the entry to "1" may be applied.

6. Second Conveyance Control Mode

In the flat-pass recording according to this embodiment, a recording command is received from the host apparatus 1000 in a state where the recording medium is nipped by the conveying roller M3060 and the pinch roller group M3070 and by the eject rollers M3100 and M3110 and a driving-roller system of the spur rollers M3120. Therefore, since it is difficult to adjust the initial phase of the conveying roller M3060 using the second correction value, conveyance control is performed using only the first correction value.

In detail, when performing flat-pass recording, a roller initial-phase adjustment is not carried out, and the phase of the roller when the trailing end of the recording medium (which acts as the leading end during recording) passes the flat-pass sheet detecting sensor M3170 is detected as the recording medium is delivered into the apparatus body. Then, the size of the recording medium is calculated from the recording command information, and the number of pulses required until the trailing end of the recording medium disengages from the roller is calculated from the recording mode, so that the rotational phase of the roller when the trailing end of the recording medium disengages from the roller can be predicted.

In the recording apparatus according to this embodiment, the distance from the nip portion between the conveying roller M3060 and the pinch roller group M3070 to the flat-pass sheet detecting sensor M3170 is 52.15 mm. When flat-pass recording is to be performed on a recording medium of an A4-size (297 mm), the trailing end of the recording medium (which acts as the leading end during recording) is made to disengage from the roller at a phase at which the roller is forward-rotated by 244.85 mm(=297−52.15) from the phase corresponding to the detection of the trailing end. Supposing that the phase of the conveying roller M3060 when the trailing end is detected by the flat-pass sheet detecting sensor M3170 is "10", the phase is equivalent to 1280 pulses when converted to the number of pulses, and is equivalent to 9499 pulses when the trailing end disengages from the roller. When converted to phase block, this is equivalent to block "74", and the first correction value ($Z_n$) corresponding to the block group H in FIG. 18 is applied.

This embodiment is also applicable to when performing duplex recording by back-feeding and turning over a recording medium, having undergone front-face recording, in the sheet feeding path within the recording apparatus and then performing reverse-face recording thereon. Specifically, when recording on the reverse face is to be commenced after the recording on the front face is completed, since the recording medium is already nipped by the driving rollers, the first correction value suitable for the roller peripheral-speed ratio corresponding to the predicted phase when the trailing end disengages from the roller is applied.

7. Other Embodiments

As described above, the recording apparatus according to this embodiment is configured to switch between the first conveyance control mode, in which the conveying amount is controlled using both the first correction value and the second correction value, and the second conveyance control mode, in which the conveying amount is controlled using only the first correction value, in accordance with the recording-medium conveyance path. Specifically, in the normal recording operation using the conveyance path extending from the auto sheet feeder, the initial phase of the roller is adjusted by using the second correction value since the recording medium is not nipped by the driving-roller system while the recording apparatus waits for a recording command. Therefore, even if the conveying amount fluctuates unexpectedly when the trailing end of the recording medium disengages from the roller, the fluctuation width of the conveying amount can be minimized. Because a conveyance path to be used is determined by information from the sheet feeder, such as the auto sheet feeder, the recording apparatus can switch between the first conveyance control mode and the second conveyance control mode on the basis of this information.

If unstable conveying processes, such as entry of the leading end of the recording medium into the nip portion of the eject rollers or disengagement of the trailing end of the recording medium from the conveying roller, occur multiple times, it is preferable that the initial phase be adjusted on the basis of a most susceptible section in an image or a section corresponding to where the average value of the roller peripheral-speed ratio is the highest.

In a recording apparatus in which a recording medium is not nipped by a driving-roller system prior to a sheet feeding operation, which has no detecting unit, such as a PE sensor, for detecting the leading and trailing ends of a recording medium, and which has no areas in the EEPROM to store first correction values, the conveyance control may be performed in the following manner. Specifically, from the first-correction-value distribution shown in FIG. 18, only the phase corresponding to the minimum $|Z_n|$ may be preliminarily stored in the EEPROM, and based on this information, the initial phase of the roller may be adjusted prior to a sheet feeding operation so that the trailing end of the recording medium is made to disengage from the roller at a rotational-phase position thereof corresponding to a small fluctuation in the conveyance error.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-321632 filed Dec. 17, 2008, which is hereby incorporated by reference herein in its entirety.

What is claimed is:

1. A recording apparatus that performs recording by using an ink-discharging recording head, the recording apparatus comprising:

a first conveying roller disposed upstream relative to the recording head in a conveying direction of a recording medium and configured to convey the recording medium;

a second conveying roller disposed downstream in the conveying direction and configured to convey the recording medium; and a controller configured to control a conveying operation of the recording medium on the basis of a first correction value and a second correction value, the first correction value being used for correcting a conveying amount when the recording medium disengages from the first conveying roller, the second correction value being used for correcting the phase of the first conveying roller and the second conveying roller when the recording medium disengages from the first conveying roller before the recording medium is nipped by the first conveying roller, wherein the controller switches the use of the first correction value and the second correction value in accordance with a conveyance path of the recording medium.

2. The recording apparatus according to claim 1, wherein the controller is capable of executing a first conveyance control mode in which the conveying operation of the recording medium is controlled by using the first correction value and the second correction value and a second conveyance control mode in which the conveying operation of the recording medium is controlled by using the first correction value but not using the second correction value.

3. The recording apparatus according to claim 1, further comprising a plurality of feeders each configured to feed the recording medium, wherein the controller switches the use of the first correction value and the second correction value in accordance with the feeders.

4. The recording apparatus according to claim 3, wherein the feeders include a first feeder that commences a feeding operation of the recording medium in a state where the recording medium is nipped by the first conveying roller, and wherein when the recording medium is fed from the first feeder, the controller executes a conveyance control mode in which the conveying operation of the recording medium is controlled by using the first correction value but not using the second correction value.

5. The recording apparatus according to claim 1, further comprising:

a memory that stores the first correction value and the second correction value for each combination of the phase of the first conveying roller and the phase of the second conveying roller; and a detecting unit configured to detect the phase of the first conveying roller and the phase of the second conveying roller, wherein the controller acquires the first correction value and the second correction value from the memory in accordance with the phase of the first conveying roller and the phase of the second conveying roller detected by the detecting unit.

6. The recording apparatus according to claim 1, wherein the first correction value is a correction value for setting a ratio between conveying amounts before and after the recording medium disengages from the first conveying roller to 1.

7. The recording apparatus according to claim 1, wherein the second correction value is a correction value for correcting the phase of the first conveying roller and the second conveying roller when the recording medium disengages from the first conveying roller so that a ratio between conveying amounts before and after the recording medium disengages from the first conveying roller is at maximum or minimum.

8. The recording apparatus according to claim 1, wherein the controller causes the recording head to record a test pattern for acquiring the first correction value and the second correction value.

9. A recording method for performing recording by using an ink-discharging recording head, the method comprising:

a conveying step of conveying a recording medium by using a first conveying roller disposed upstream relative to the recording head in a conveying direction of the recording medium and configured to convey the recording medium and by also using a second conveying roller disposed downstream in the conveying direction and configured to convey the recording medium; and a controlling step of controlling a conveying operation of the recording medium on the basis of a first correction value and a second correction value, the first correction value being used for correcting a conveying amount when the recording medium disengages from the first conveying roller, the second correction value being used for correcting the phase of the first conveying roller and the second conveying roller when the recording medium disengages from the first conveying roller before the recording medium is nipped by the first conveying roller, wherein the controlling step includes switching the use of the first correction value and the second correction value in accordance with a conveyance path of the recording medi

* * * * *